US010093497B2

(12) United States Patent
Zensai

(10) Patent No.: US 10,093,497 B2
(45) Date of Patent: Oct. 9, 2018

(54) FEEDING DEVICE AND IMAGE FORMING APPARATUS

(71) Applicant: CANON KABUSHIKI KAISHA, Tokyo (JP)

(72) Inventor: Shoichi Zensai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/727,571

(22) Filed: Jun. 1, 2015

(65) Prior Publication Data

US 2015/0344246 A1 Dec. 3, 2015

(30) Foreign Application Priority Data

Jun. 3, 2014 (JP) ..... 2014-115305

(51) Int. Cl.

| | |
|---|---|
| ***B65H 5/00*** | (2006.01) |
| ***B65H 3/06*** | (2006.01) |
| ***B65H 5/06*** | (2006.01) |
| ***B65H 1/14*** | (2006.01) |
| ***B65H 1/26*** | (2006.01) |
| ***B65H 7/04*** | (2006.01) |

(52) U.S. Cl.

CPC ..... *B65H 3/0669* (2013.01); *B65H 1/14* (2013.01); *B65H 1/266* (2013.01); *B65H 3/0684* (2013.01); *B65H 5/062* (2013.01); *B65H 7/04* (2013.01); *B65H 2402/543* (2013.01); *B65H 2403/421* (2013.01); *B65H 2403/512* (2013.01); *B65H 2403/53* (2013.01); *B65H 2403/541* (2013.01); *B65H 2403/721* (2013.01); *B65H 2403/732* (2013.01); *B65H 2405/114* (2013.01); *B65H 2511/515* (2013.01); *B65H 2513/40* (2013.01); *B65H 2601/324* (2013.01)

(58) Field of Classification Search

CPC ..... B65H 3/0669; B65H 3/0684; B65H 3/06

See application file for complete search history.

(56) References Cited

U.S. PATENT DOCUMENTS

| | | | | |
|---|---|---|---|---|
| 5,755,435 | A * | 5/1998 | Fujiwara | H04N 1/00567 271/10.04 |
| 7,458,571 | B2 * | 12/2008 | Ogawa | B65H 1/08 271/118 |
| 2008/0128973 | A1 * | 6/2008 | Hirose | B65H 3/0684 271/117 |
| 2011/0156342 | A1 * | 6/2011 | Iino | B65H 3/0684 271/10.11 |
| 2016/0159590 | A1 * | 6/2016 | Zensai | B65H 3/0684 271/118 |

FOREIGN PATENT DOCUMENTS

| | | | |
|---|---|---|---|
| CN | 1149028 | A | 5/1997 |
| CN | 102556742 | A | 7/2012 |
| JP | S58148131 | A | 9/1983 |
| JP | H0958887 | A | 3/1997 |
| JP | H11-005640 | A | 1/1999 |

(Continued)

*Primary Examiner* — Howard J Sanders

(74) *Attorney, Agent, or Firm* — Canon USA, Inc., IP Division

(57) ABSTRACT

A pickup roller is moved to a retracted position by rotating a feeding motor in reverse by a first predetermined amount and is moved to a contact position by rotating the feeding motor forward by a second predetermined amount.

12 Claims, 22 Drawing Sheets

(56) References Cited

FOREIGN PATENT DOCUMENTS

| | | | |
|---|---|---|---|
| JP | H11147625 | A | 6/1999 |
| JP | 2006-096547 | A | 4/2006 |
| JP | 2006-111373 | A | 4/2006 |
| JP | 2007-145543 | A | 6/2007 |
| JP | 04168279 | B2 | 10/2008 |
| JP | 2012-197130 | A | 10/2012 |
| JP | 2013-010611 | A | 1/2013 |
| JP | 2013-121862 | A | 6/2013 |

* cited by examiner

FEEDING DEVICE AND IMAGE FORMING APPARATUS

BACKGROUND OF THE INVENTION

Field of the Invention

The present invention relates to a feeding device and an image forming apparatus.

Description of the Related Art

There have hitherto been image forming apparatuses, such as a copying machine, a printer, and a facsimile, including a sheet feeding device that supplies sheets to an image forming section. The sheet feeding device includes a sheet container unit that contains sheets to be fed. An example of such a sheet container unit is a feeding cassette detachably mounted in an image forming apparatus.

FIG. 19 illustrates a feeding cassette disclosed in Japanese Patent Laid-Open No. 2013-10611. In a feeding cassette 900, an intermediate plate 901 is provided pivotally on a pivot shaft 903*a* relative to a casing 903 in the upward and downward directions. A lifting plate 902 pushes up a downstream side of the intermediate plate 901 in a sheet feeding direction. Thus, sheets on the intermediate plate 901 are brought into contact with a pickup roller (feed roller) 904 with a predetermined pressing force. Sheets S pushed up by the intermediate plate 901 are fed out in a stable state by the pickup roller 904 and a conveying roller 905 downstream thereof. Then, images are formed on the sheets S conveyed from the feeding cassette 900.

As the market needs, there has recently been a strong demand to shorten the first print output time (FPOT) of the image forming apparatus. Further, from the viewpoint of usability, it is particularly effective to shorten the FPOT of the image forming apparatus. To shorten the FPOT under such circumstances, one problem is how to shorten the time required to convey a sheet to the image forming section after a print command is received from a personal computer or the like. For this reason, the image forming apparatus is preferably on standby with the pickup roller and the sheet being in contact with each other at the time when the print command is received.

On the other hand, in the market, there is a demand for an image forming apparatus that can use various types of sheets including thin paper having a basis weight of about 50 g/m$^2$ and glossy paper for obtaining a high-quality print.

Among various types of sheets, there is a sheet that locally deforms or a sheet that changes in surface property in a portion in contact with the pickup roller when the standby state in which the pickup roller and the sheet are in contact continues for a long time (for example, one day or more). As a result, these may cause image defects.

SUMMARY OF THE INVENTION

The present invention provides a feeding device and an image forming apparatus that can shorten the FPOT, use various types of sheets, and obtain good images.

A feeding device according to an aspect of the present invention feeds a sheet and includes a stack member on which the sheet is stacked, a driving unit configured to generate a driving force of forward rotation and a driving force of reverse rotation, a feeding member configured to feed the sheet stacked on the stack member by rotating in contact with the sheet and provided rotatably by the driving force of forward rotation from the driving unit, and a moving unit configured to move the feeding member located at a contact position in contact with the sheet stacked on the stack member to a retracted position retracted upward from the contact position by the driving force of reverse rotation from the driving unit and to move the feeding member located at the retracted position to the contact position by the driving force of forward rotation from the driving unit. The moving unit includes a one-way clutch configured to move the feeding member from the contact position to the retracted position by the driving force of reverse rotation from the driving unit.

Further features of the present invention will become apparent from the following description of exemplary embodiments with reference to the attached drawings.

DESCRIPTION OF THE EMBODIMENTS

Figure 1:
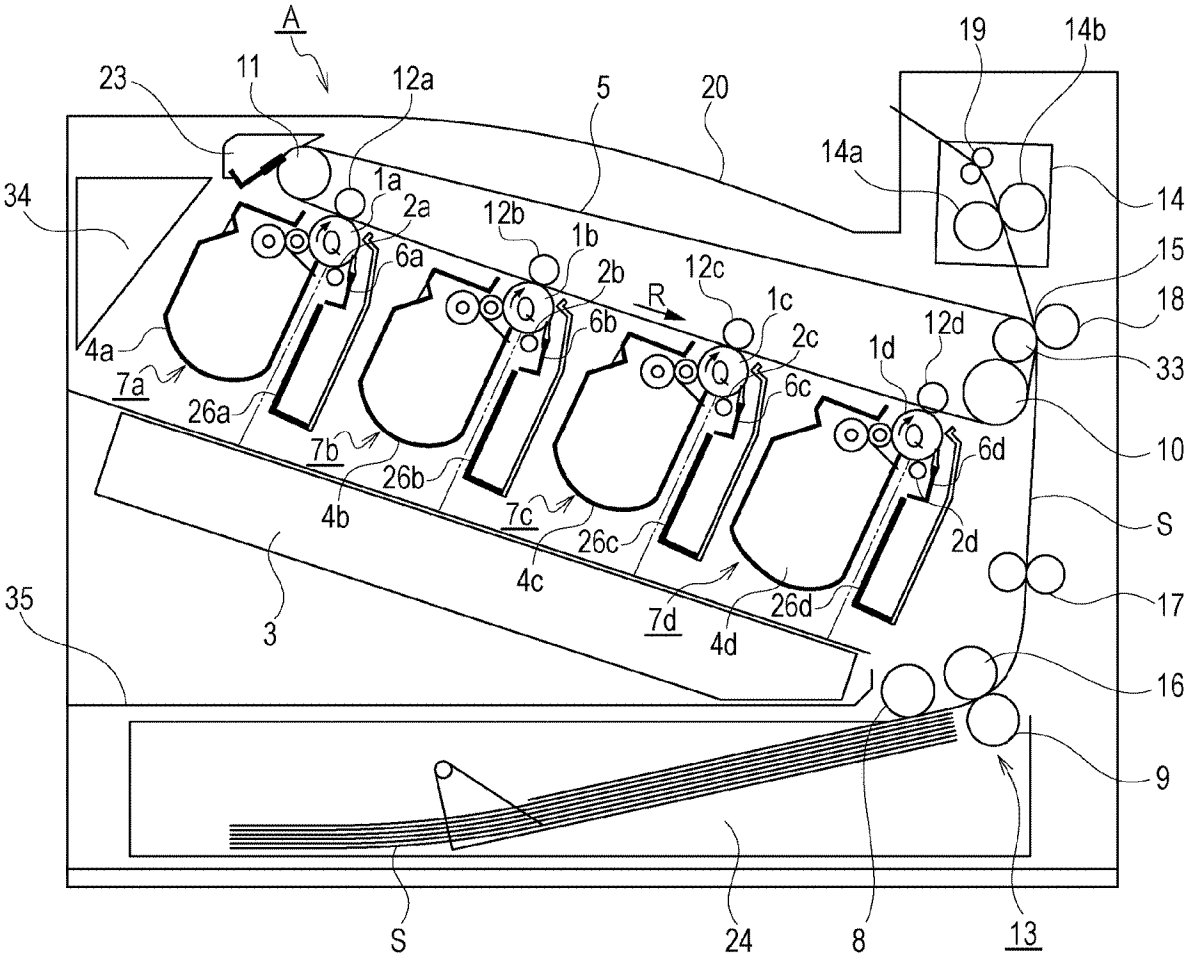
FIG. 1 is a schematic cross-sectional view of an image forming apparatus according to a first embodiment.

Preferred embodiments of the present invention will be exemplarily described in detail below with reference to the drawings. The dimensions, materials, shapes, and relative arrangements of the constituent components adopted in the following embodiments should be appropriately changed according to the configuration and various conditions of the apparatus to which the present invention is applied. Therefore, the present invention should not be limited to the following embodiments, unless otherwise specified.

First Embodiment

An image forming apparatus according to a first embodiment will be described with reference to FIGS. 1 to 15A and 15B. In the following description, the overall configuration of the image forming apparatus will be first described with reference to FIG. 1. Next, the structure of a sheet feeding device will be described with reference to FIGS. 2A and 2B to 13A and 13B.

First, the overall configuration of the image forming apparatus will be described with reference to FIG. 1. An image forming apparatus A includes four process cartridges 7 (7*a* to 7*d*) juxtaposed while being inclined with respect to the horizontal direction. The process cartridges 7 (7*a* to 7*d*) include their respective electrophotographic photosensitive drums 1 (1*a* to 1*d*), each of which serves as one image bearing member.

The electrophotographic photosensitive drums (hereinafter referred to as "photosensitive drums") 1 are rotated by a driving member (not illustrated) in the clockwise direction (direction of arrow Q) in FIG. 1. Around each of the photosensitive drums 1, the following process units 2, 3, 4, 5, and 6 that work on the photosensitive drums 1 are arranged. Charging rollers 2 (2*a* to 2*d*) uniformly charge surfaces of the respective photosensitive drums 1. Developing units 4 (4*a* to 4*d*) develop electrostatic latent images with toner serving as developing agent. Cleaning members 6 (6*a* to 6*d*) remove toner remaining on the surfaces of the photosensitive drums 1 after transfer. A scanner unit 3 forms electrostatic latent images on the photosensitive drums 1 by the application of a laser beam on the basis of image information. On an intermediate transfer belt 5, developer (hereinafter referred to as "toner") images of four colors on the photosensitive drums 1 are transferred. Here, the photosensitive drums 1, the charging rollers 2, the developing units 4, and the cleaning members 6 are integrated into cartridges to constitute process cartridges 7 that are detachably loaded in a loading part of the image forming apparatus A.

The intermediate transfer belt 5 is stretched by a driving roller 10, a tension roller 11, and an opposing roller 33 for secondary transfer. On an inner side of the intermediate transfer belt 5, primary transfer rollers 12 (12*a* to 12*d*) are provided to be opposed to the photosensitive drums 1 (1*a* to 1*d*), respectively. To the primary transfer rollers 12, transfer bias is applied by a bias application unit (not illustrated).

Toner images of four colors formed on the photosensitive drums 1 are sequentially primary-transferred onto the intermediate transfer belt 5 as the photosensitive drums 1 rotate in the direction of arrow Q, the intermediate transfer belt 5 rotates in a direction of arrow R, and a bias of positive polarity is applied to the primary transfer rollers 12. The toner images of four colors primary-transferred on the intermediate transfer belt 5 are conveyed to a secondary transfer portion 15 while being superimposed on the intermediate transfer belt 5.

On the other hand, toner remaining on the surfaces of the photosensitive drums 1 is removed by the cleaning members 6. The removed toner is collected into removed-toner chambers provided in photosensitive member units 26 (26*a* to 26*d*).

In synchronization with the above-described image forming operation, sheets serving as recording media are conveyed by a feeding device 13, a registration roller pair 17, etc. The feeding device 13 includes a feeding cassette 24 that contains sheets S, a pickup roller 8 that feeds the sheets S, a feed roller 16 that conveys the fed sheets S to the registration roller pair 17, and a separation roller 9 opposed to the feed roller 16. When a plurality of sheets S are fed by the pickup roller 8, they are frictionally separated one by one by a set torque of a torque limiter incorporated in the separation roller 9.

Above the feeding cassette 24, an above-cassette stay 35 serving as a part of a structure is provided to separate the feeding cassette 24 and the image forming section. The feeding cassette 24 can be drawn out to the front side of the apparatus in FIG. 1. The user can complete supply of sheets S by drawing the feeding cassette 24 out from a main body of the apparatus, setting the sheets S in the feeding cassette 24, and then inserting the feeding cassette 24 into the main body of the apparatus. The sheets S contained in the feeding cassette 24 are picked up by the pickup roller 8. Then, as described above, the sheets S are separated and conveyed one by one at a nip between the feed roller 16 and the separation roller 9.

Next, a sheet S conveyed from the feeding device 13 is conveyed to the secondary transfer portion 15 by the registration roller pair 17. At the secondary transfer portion 15, toner images of four colors on the intermediate transfer belt 5 are secondary-transferred onto the conveyed sheet S by applying a bias of positive polarity to a secondary transfer roller 18.

Toner remaining on the intermediate transfer belt 5 after secondary transfer on the sheet S is removed by a transfer-belt cleaning device 23. The removed toner passes through a waste-toner conveying path (not illustrated), and is collected into a waste-toner collecting container 34 disposed in the left side part of the apparatus.

On the other hand, a fixing device 14 serving as a fixing unit fixes the transferred toner images on the sheet S by applying heat and pressure to the toner images. A fixing belt 14*a* is cylindrical, and is guided by a belt guide member (not illustrated) to which a heating unit, such as a heater, is stuck. The fixing belt 14*a* and a pressure roller 14*b* form a fixing nip with a predetermined pressing force.

The sheet S on which an unfixed toner image is formed and which is conveyed from the secondary transfer portion 15 is heated and pressed at the fixing nip between the fixing belt 14*a* and the pressure roller 14*b*, and the unfixed toner image is fixed on the sheet S. After that, the fixed sheet S is discharged onto a discharge tray 20 by a discharge roller pair 19.

Outline of Feeding Device

As illustrated in FIG. 1, the feeding device 13 of the first embodiment is disposed in a lower part of the image forming apparatus A. The feeding cassette 24 is detachable from the main body of the image forming apparatus A. The feeding device 13 feeds sheets S stacked on a stack plate (stack member) 21 one by one toward the image forming section (secondary transfer portion 15 and fixing device 14) set in an upper part of the image forming apparatus A.

Figure 2A:
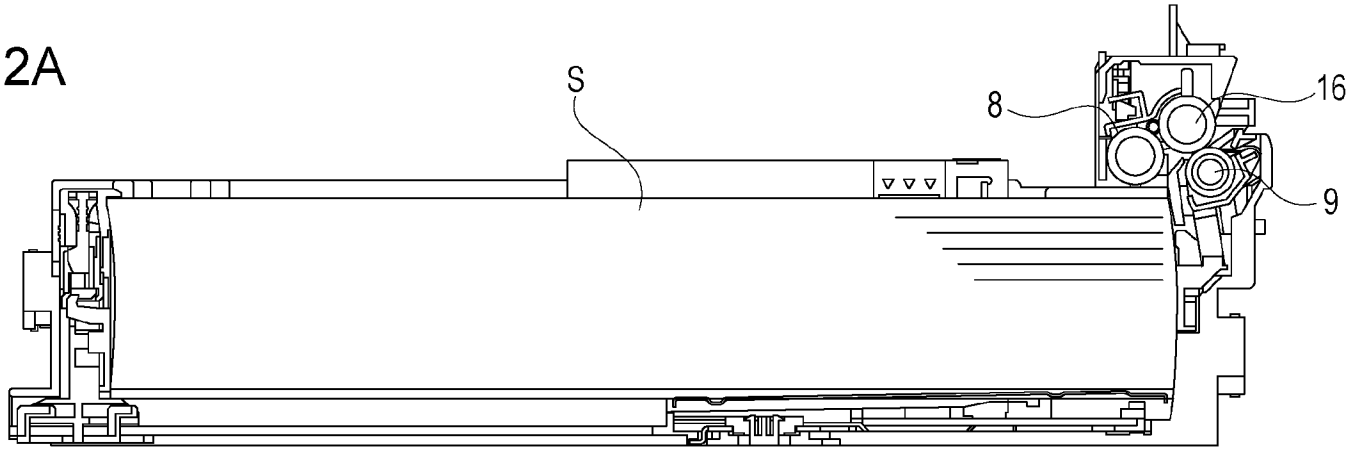
FIGS. 2A and 2B are cross-sectional views of a feeding device according to the first embodiment.
Figure 2B:
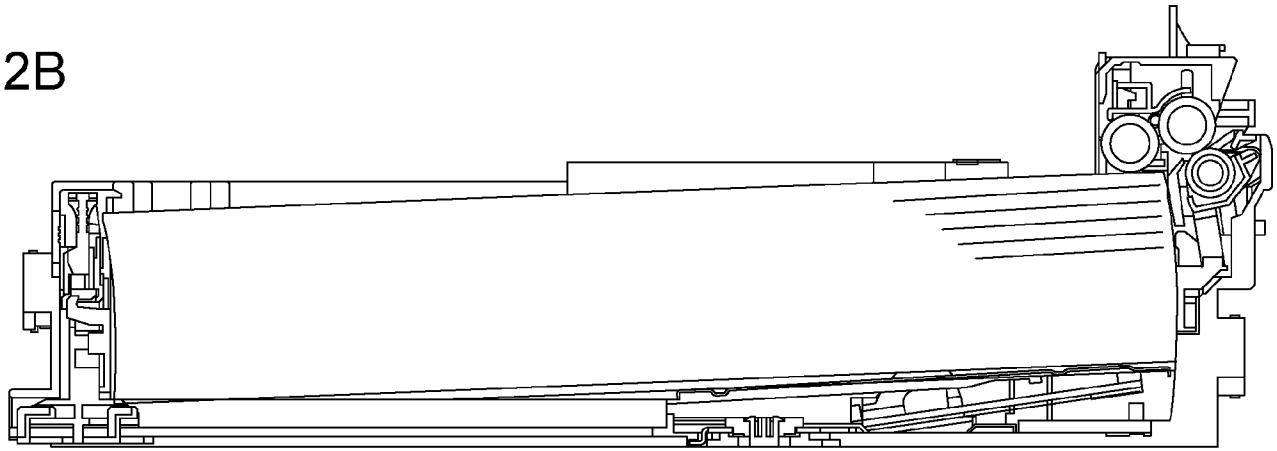

FIGS. 2A and 2B are cross-sectional views illustrating the structure of the feeding device 13. A detailed structure of the feeding device 13 will be described with reference to FIGS. 2A and 2B. FIG. 2A illustrates a state in which sheets S are stacked on the stack plate 21 in the feeding device 13. FIG. 2B illustrates a state in which the stack plate 21 is lifted from the state of FIG. 2A to allow feeding of the sheets S on the stack plate 21.

The feeding device 13 includes a pickup roller (feeding member) 8 that feeds out the sheets S stacked on the stack plate 21 from the uppermost sheet. The pickup roller 8 feeds the sheets S stacked on the stack plate 21 by rotating in contact with the sheets S. The feeding device 13 further includes a feed roller 16 that rotates in a sheet conveying direction to convey the sheets S fed by the pickup roller 8, and a separation roller 9 that is in pressure contact with the feed roller 16. At a separation nip portion formed by the feed roller 16 and the separation roller 9, the sheets S are separated and conveyed one by one. Between the separation roller 9 and a shaft of the separation roller 9, an unillustrated torque limiter is provided. The torque of the torque limiter is set so that, when one sheet is fed by the pickup roller 8, the separation roller 9 rotates to follow the sheet S conveyed by the feed roller 16. The torque of the torque limiter is set so that, when two sheets are fed by the pickup roller 8, the separation roller 9 does not rotate to prevent feeding of a lower sheet S (second sheet S) of the sheets S in contact with the pickup roller 8.

Figure 3A:
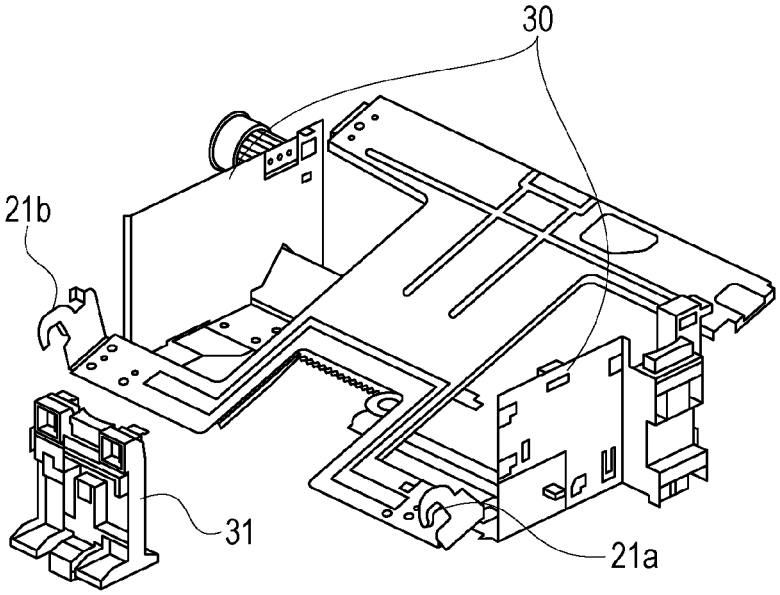
FIGS. 3A and 3B are perspective views of a feeding cassette in the first embodiment.
Figure 3B:
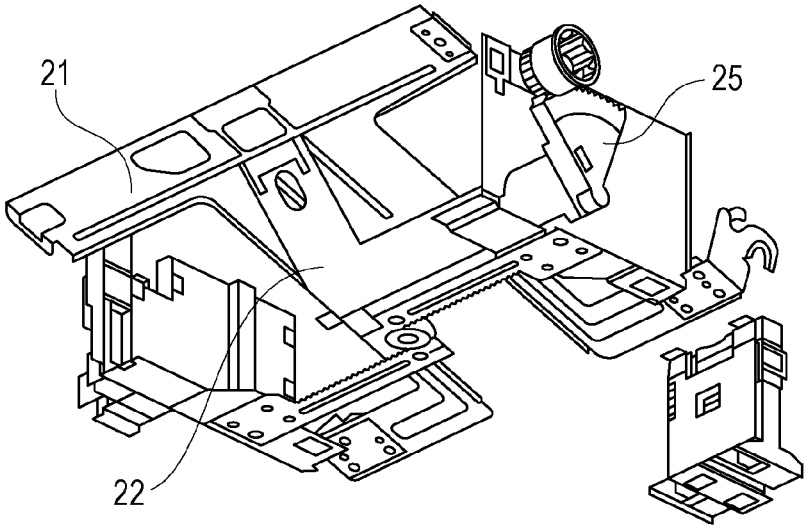

A description will be given of a lift operation of the stack plate 21 for lifting the sheets S to a position that allows feeding. As illustrated in FIGS. 3A and 3B, the stack plate 21 is provided in the feeding cassette 24, and can pivot (move) on retaining portions 21*a* and 21*b* in the up-down direction.

A lifting plate 22 is provided below the stack plate 21, and lifts up the stack plate 21. The lifting plate 22 has a fan-shaped gear 25 at one end. The fan-shaped gear 25 is meshed with a pinion 27 provided in the feeding cassette 24 to be rotated by driving force of a feeding motor M (driving unit) illustrated in FIGS. 6A and 6B. The fan-shaped gear 25 turns when the pinion 27 rotates, and the lifting plate 22 pivots upward when the fan-shaped gear 25 turns. Thus, the stack plate 21 pivots upward, and the sheets S on the stack plate 21 are moved up to the position such that the sheets S can be fed by the pickup roller 8. The pinion 27, the fan-shaped gear 25, the lifting plate 22, etc. constitute a lifting unit that lifts the stack plate 21.

Figure 8:
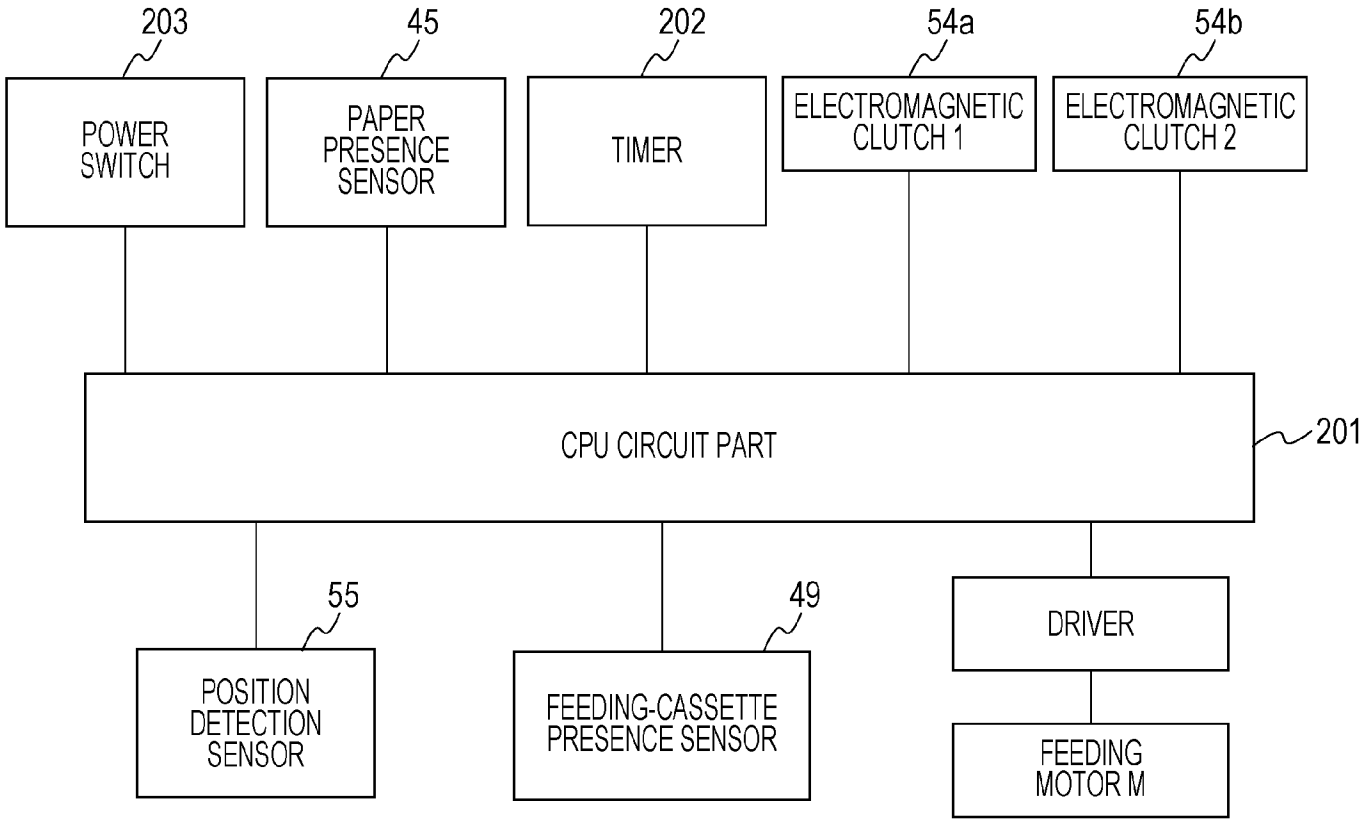
FIG. 8 is a block diagram showing a configuration of a controller that controls the image forming apparatus of the first embodiment.

The feeding motor M can generate a driving force of forward rotation and a driving force of reverse rotation. As illustrated in FIG. 8, driving of the feeding motor M is controlled by a CPU circuit part 201 (control unit). The CPU circuit part 201 rotates the pinion 27 by driving the feeding motor M on the basis of a detection signal from a position detection sensor 55 to be described later. The stack plate 21 is thereby moved up until the position of the upper surface of the sheets S stacked on the stack plate 21 reaches a predetermined position (position that allows feeding).

Side regulation members 30 regulate the positions of the sheets S stacked on the stack plate 21 in a direction (widthwise direction) intersecting the feeding direction at right angles. The side regulation members 30 are provided in the feeding cassette 24 to be movable in the widthwise direction. Further, the side regulation members 30 are movable independently of the stack plate 21, and can regulate the sheets S in the widthwise direction while maintaining the fixed state even during movement (upward movement) of the stack plate 21. A trailing-edge regulation member 31 regulates the positions of the sheets S stacked on the stack plate 21 at an upstream end (trailing edge) in the feeding direction. The trailing-edge regulation member 31 is provided in the feeding cassette 24 to be movable in the feeding direction.

Figure 4A:
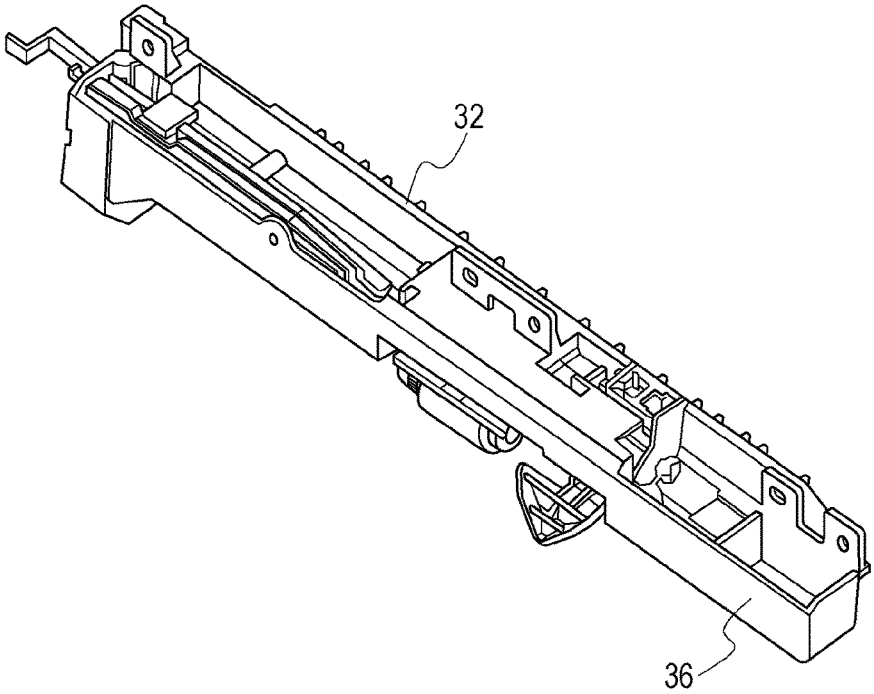
FIGS. 4A and 4B are perspective views of a feeding frame unit in the first embodiment.
Figure 4B:
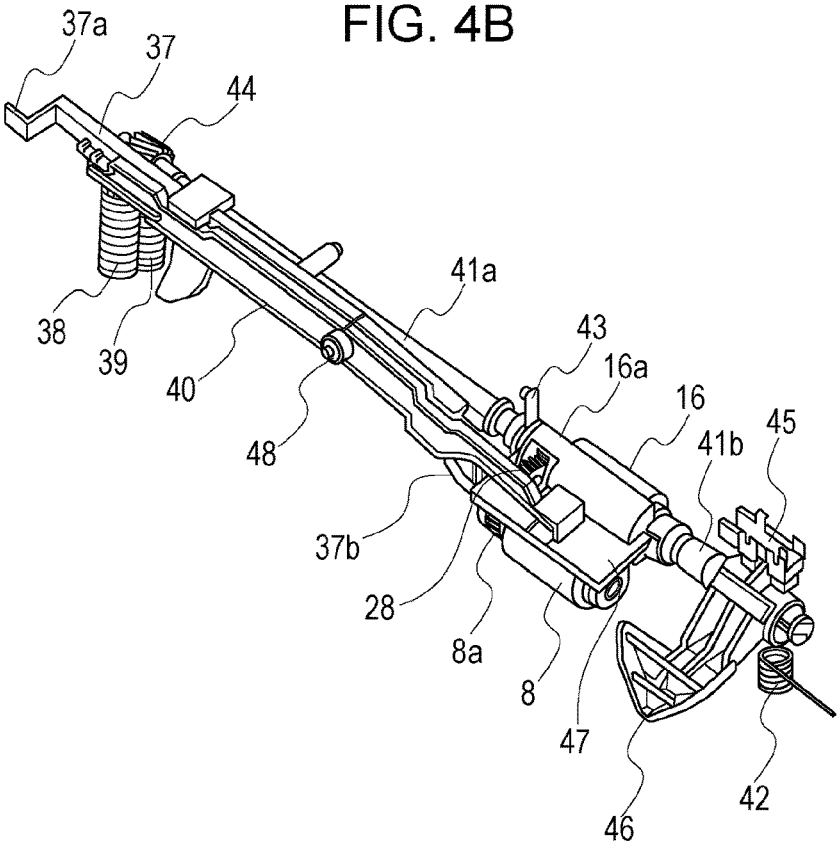

A feeding frame unit 32 will be described with reference to FIGS. 4A and 4B. In FIG. 4B, a feeding frame 36 is removed from FIG. 4A for explanation. The feeding frame unit 32 includes a position detection lever 37, compression springs 38 and 39, a press lever 40, the pickup roller 8, the feed roller 16, feed-roller shafts 41 (41*a* and 41*b*), a torsion coil spring 42, a bearing 43, a gear 44, a paper presence sensor 45, and a paper presence flag 46. These components are held in the feeding frame 36.

Holding of the pickup roller 8 and the feed roller 16 will be described. The pickup roller 8 is held by a roller holder (holding member) 47, and the roller holder 47 can pivot on the feed-roller shafts 41*a* and 41*b*.

The feed roller 16 is attached to the feed-roller shafts 41*a* and 41*b*. The feed-roller shaft 41*a* is held by the bearing 43 to be rotatable relative to the feeding frame 36. The feed-roller shaft 41*b* rotatably supports the other side of the feed roller 16. The feed-roller shaft 41*b* is held to be slidable relative to the feeding frame 36 in the axial direction. The torsion coil spring 42 is provided between the feed-roller shaft 41*b* and the feeding frame 36. The user can replace the roller holder 47 holding the feed roller 16 and the pickup roller 8 by sliding the feed-roller shaft 41*b* as necessary.

A description will be given of the structure and operation for pressing the pickup roller 8 against the sheets S. The press lever 40 attached to the feeding frame 36 is held to turn on a shaft portion 48 at about the center thereof relative to the feeding frame 36. The compression spring 38 works on one end of the press lever 40 so that the other end of the press lever 40 is in contact with the roller holder 47. This ensures a desired feeding pressure of the pickup roller 8 against the sheets S. That is, the compression spring 38 functions as an elastic member that generates elastic force for contact of the pickup roller 8 with the sheets S. The press lever 40 functions as a connecting member that connects the compression spring 38 and the roller holder 47.

The paper presence flag 46 and the paper presence sensor 45 constitute a sheet presence detection unit that detects the presence or absence of sheets S on the stack plate 21. When the sheets S are stacked on the stack plate 21, the paper presence flag 46 shields the paper presence sensor 45 from light during upward movement of the stack plate 21. In contrast, when the sheets S are not stacked on the stack plate 21, the paper presence flag 46 falls into a hole provided in the stack plate 21. Therefore, the paper presence flag 46 does not shield the paper presence sensor 45 from light (transmits light).

Figure 5B:
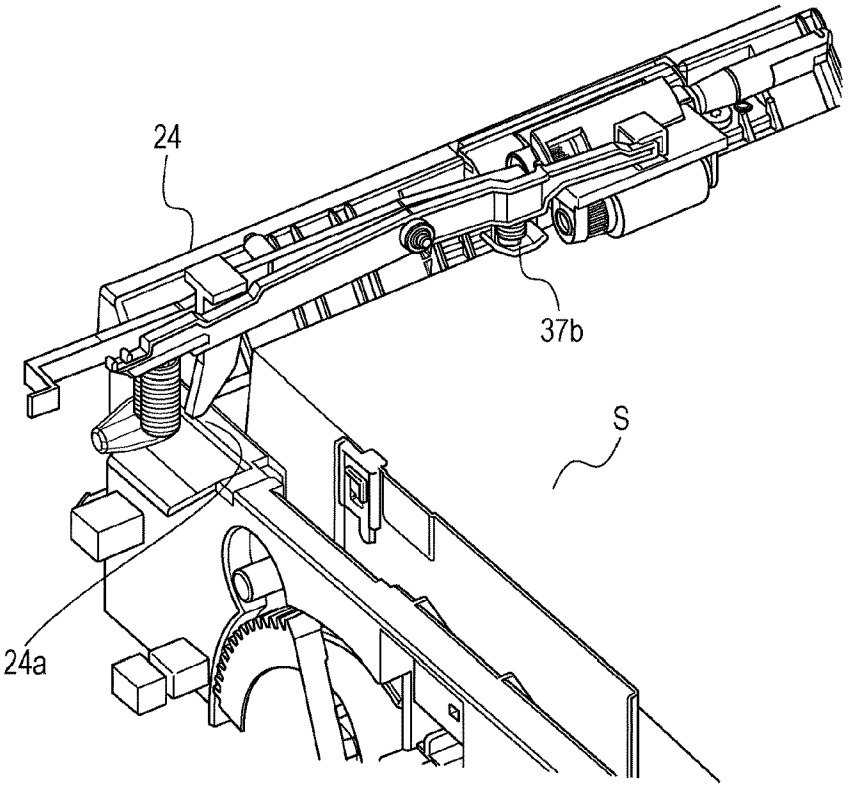
FIGS. 5A and 5B are perspective views illustrating the relationship between the feeding frame unit and the feeding cassette in the first embodiment.
Figure 5A:
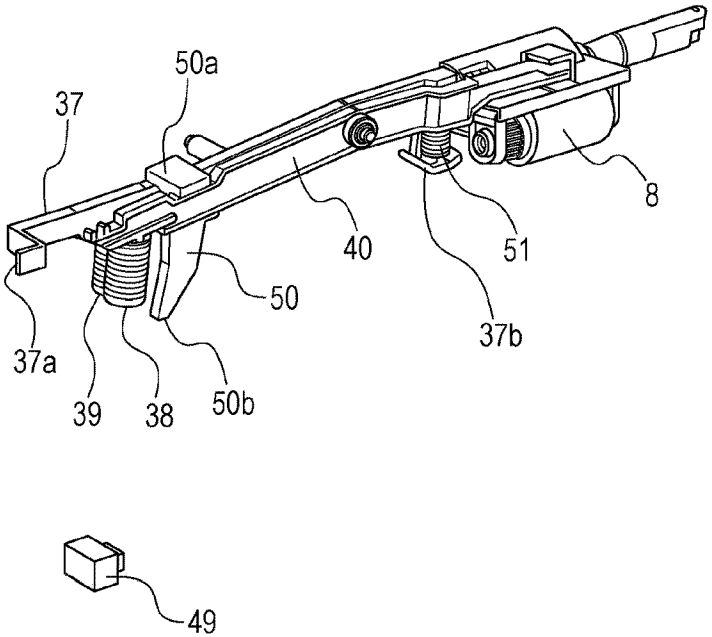

FIGS. 5A and 5B illustrate the relationship between the feeding frame unit 32 and the feeding cassette 24. FIG. 5A illustrates a state in which the feeding cassette 24 is not loaded in the image forming apparatus A. FIG. 5B illustrates a state in which the feeding cassette 24 is loaded in the image forming apparatus A. The image forming apparatus A includes a push switch 49 that detects that the feeding cassette 24 is loaded. The feeding frame unit 32 is provided with a release lever 50 such as to minimize rubbing between the pickup roller 8 and the sheets S when the feeding cassette 24 is inserted and drawn out. The release lever 50 can be turned on the shaft portion 48 by the action of a compression spring 51 provided on a side of the pickup roller 8.

When the feeding cassette 24 is drawn out of the feeding device 13, the position detection lever 37 and the press lever 40 are pushed downward in FIGS. 5A and 5B (turned in the counterclockwise direction) by a release portion 50*a* of the release lever 50 that receives upward force in FIGS. 5A and 5B from the compression spring 51. When the press lever 40 turns in the counterclockwise direction, the pickup roller 8 retracts upward. The release lever 50 stops at a position in contact with an unillustrated contact portion of the feeding frame 36. The moment of the compression spring 51 is set to exceed the moments of the compression springs 38 and 39.

During a process in which the feeding cassette 24 is inserted in the feeding device 13, a rib 50*b* of the release lever 50 runs on a side wall 24*a* of the feeding cassette 24. Thus, the position detection lever 37 and the press lever 40 turn in the clockwise direction, and retraction of the pickup roller 8 is released. Then, in a state in which the feeding cassette 24 is loaded in the feeding device 13, the position detection lever 37 and the press lever 40 can operate within the range required for the feeding operation.

Figure 6A:
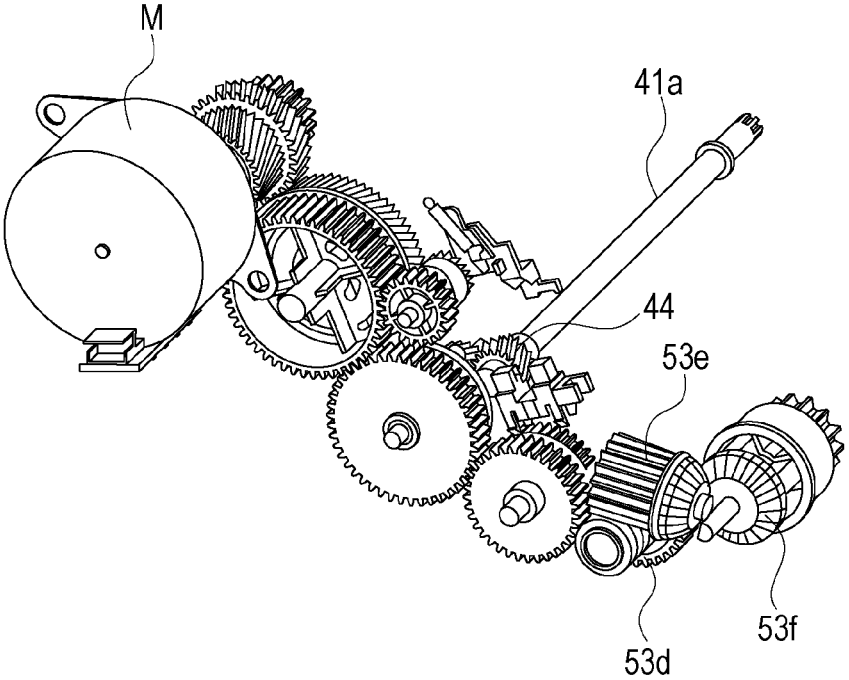
FIGS. 6A and 6B are perspective views illustrating a driving transmission path from a feeding motor in the first embodiment.
Figure 6B:
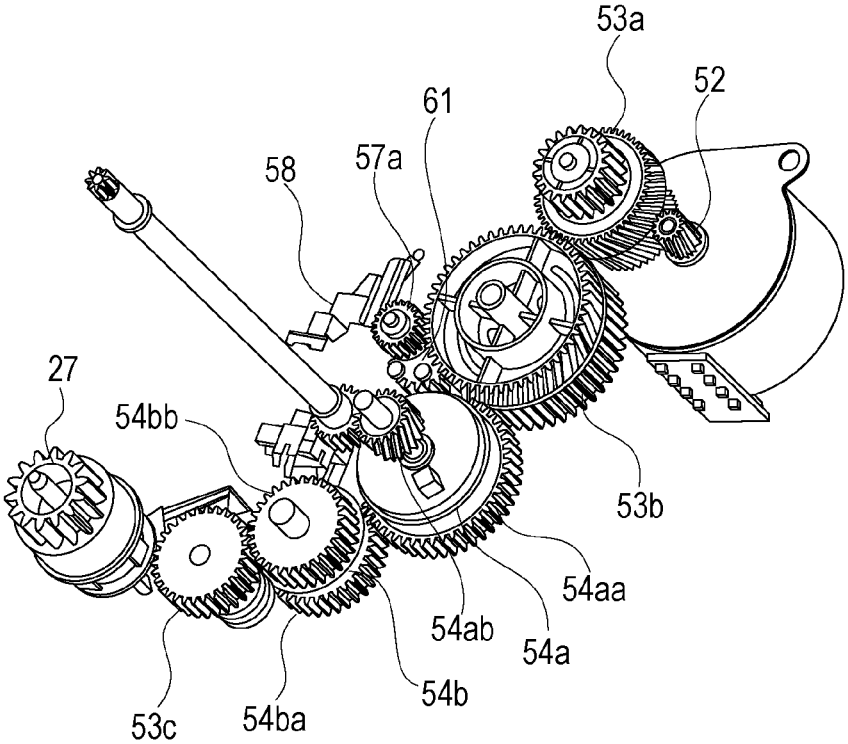

FIGS. 6A and 6B illustrate a driving transmission path from the feeding motor M. The feeding motor M drives the pickup roller 8, the feed roller 16, and the pinion 27. The feeding motor M is coupled to electromagnetic clutches 54*a* and 54*b* via a pinion 52 and a deceleration gear 53. The electromagnetic clutches 54*a* and 54*b* transmit and cut off driving from the feeding motor M. Only while the electromagnetic clutches 54*a* and 54*b* are electrified, the driving from the feeding motor M is transmitted to gears 54*ab* and 54*bb* via gears 54*aa* and 54*ba* illustrated in FIGS. 6A and 6B. By transmitting the driving from the feeding motor M via the electromagnetic clutches 54*a* and 54*b*, variation in driving transmission can be reduced.

The gear 54*ab* is coupled to the feed-roller shaft 41*a*. When the feeding motor M rotates and the gear 54*ab* rotates, the feed roller 16 (feed-roller shaft 41*a*) also rotates. The electromagnetic clutch 54*b* controls the driving transmission from a gear 53*c* to the pinion 27 for pivoting the lifting plate 22. A worm gear 53*d* and a worm wheel 53*e* are interposed in a drive train from the electromagnetic clutch 54*b* to the pinion 27. Therefore, even when transmission of the electromagnetic clutch 54*b* is interrupted, the gears are not reversed by the weight of the sheets S, and the stack plate 21 is not lowered.

A gear 16*a* is attached to the shaft of the feed roller 16 with an unillustrated one-way clutch being disposed therebetween. The gear 16*a* transmits driving to a gear 8*a* provided on the rotating shaft of the pickup roller 8. A one-way clutch is also incorporated in the shaft of the pickup roller 8. According to this structure, back tension to the registration roller pair 17 can be kept down when the velocity ratio of the rollers is such that the velocity decreases in the order of the registration roller pair 17, the feed roller 16, and the pickup roller 8. Further according to this structure, the contact state between the pickup roller 8 and the sheets S can also be maintained in the period from when the pickup roller 8 feeds a preceding sheet to when the pickup roller 8 feeds a succeeding sheet. Therefore, according to this structure, it is possible to decrease the feeding interval (interval between the preceding sheet and the succeeding sheet) and to shorten the time from when a feeding operation start command is given to when the sheet S is actually fed. As a result, the FPOT can be shortened.

Figure 7:
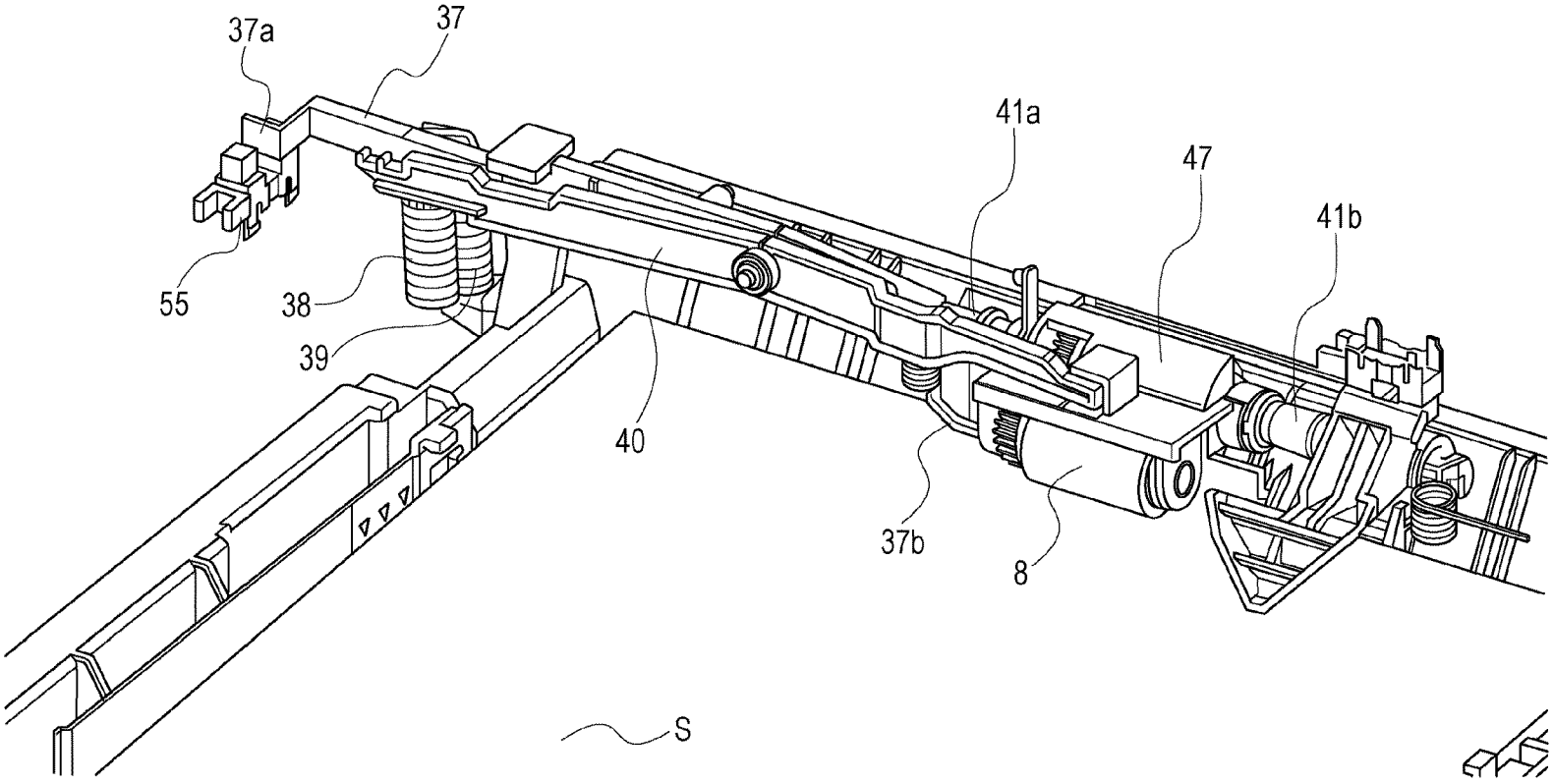
FIG. 7 is a perspective view illustrating a structure for detecting the position of a paper surface of a sheet in the first embodiment.

Next, the structure and operation for detecting the position of the paper surface of the sheets S on the stack plate 21 will be described with reference to FIG. 7. The feeding device 13 includes a photo-interruptor serving as a position detection sensor 55. When the sheets S on the stack plate 21 are at a predetermined position such as to be ready to be fed by the pickup roller 8, the position detection sensor 55 is shielded by a flag-shaped portion 37*a* of the position detection lever 37 illustrated in FIG. 5A. Further, the compression spring 39 is provided at an end portion on an opposite side of the turn center of the position detection lever 37 so that a contact portion 37*b* of the position detection lever 37 reliably comes into contact with the sheets S.

As the sheets S are sequentially fed according to a feeding signal, the height of the upper surface of the sheets S stacked on the stack plate 21 decreases. Correspondingly, the roller holder 47 pivots on the feed-roller shafts 41*a* and 41*b*, and moves down together with the pickup roller 8. Further, the press lever 40 and the position detection lever 37 also pivot to follow the downward movement of the paper surface. As a result, light shielding by the contact portion 37*b* is released, and the position detection sensor 55 is brought into a non-detection state. When the position detection sensor 55 is thus brought into the non-detection state, a control section (to be described later) controls the driving of the electromagnetic clutch 54*b*, and lifts up the stack plate 21 so that the sheets S on the stack plate 21 reach the predetermined position. That is, the control unit lifts up the stack plate 21 until the sheets S on the stack plate 21 turn the position detection lever 37 and the position detection sensor 55 is shielded by the flag-shaped portion 37*a*. By repeating this control, the position of the upper surface of the sheets S can be kept substantially fixed at the predetermined position that allows feeding until the sheets S on the stack plate 21 run out. Thus, the pickup roller 8 can reliably feed the sheets S.

FIG. 8 is a block diagram of the image forming apparatus A. As illustrated in FIG. 8, the controller in the image forming apparatus A includes the CPU circuit part 201 serving as a control unit.

The CPU circuit part 201 is connected to a feeding-cassette presence sensor 49 and a timer 202, and can obtain detection results of the sensors and the measurement time of the timer 202. The CPU circuit part 201 is also connected to the electromagnetic clutch 54*a* and the electromagnetic clutch 54*b*. The CPU circuit part 201 is also connected to the feeding motor M via a driver, and controls driving of the feeding motor M.

Next, a description will be given of the structure and control for moving the pickup roller 8 into contact with and away from the sheets S on the stack plate 21 with reference to FIGS. 9A, 9B, 10A, and 10B.

A driving frame 56 holding the feeding motor M holds gears 57*a* and 57*b* to be meshed with a gear 53*b* illustrated in FIGS. 6A and 6B and a separation member 58. Between the gear 57*a* and the gear 57*b*, a one-way clutch (clutch member) 59 is provided. The separation member 58 has a rack gear engaged with the gear 57*b*. A tension spring (elastic member) 60 works between the separation member 58 and the driving frame 56. By the elastic force of the tension spring 60, the separation member 58 is stopped at a position (first position) where a boss shape 58*a* of the separation member 58 is caught in a guide hole 56*a* of the driving frame 56. That is, the separation member 58 is elastically biased to the first position by the tension spring 60. An inverse-U shaped portion is provided on an opposite side to the separation member 58, and is engaged with an engaging portion 40*c* of the press lever 40.

The operation of the one-way clutch 59 will be described. When the feeding motor M rotates in reverse (in a direction opposite from a direction for the feeding operation), the gear 57*a* rotates in the clockwise direction (direction of solid arrow) in FIGS. 10A and 10B. The one-way clutch 59 receives thrust force from a cam-shaped portion 57*ab* provided in the gear 57*a*, and moves in a direction of dashed arrow in FIG. 10A. A gear portion 59*a* of the one-way clutch 59 engages with serrations of the gear 57*b*, and the rotation of the gear 57*a* is transmitted to the gear 57*b*. To prevent the one-way clutch 59 from continuing idling without following the cam-shaped portion 57*ab* of the gear 57*a*, a spring member 61 works on the one-way clutch 59 to give load in the radial direction.

Figure 10A:
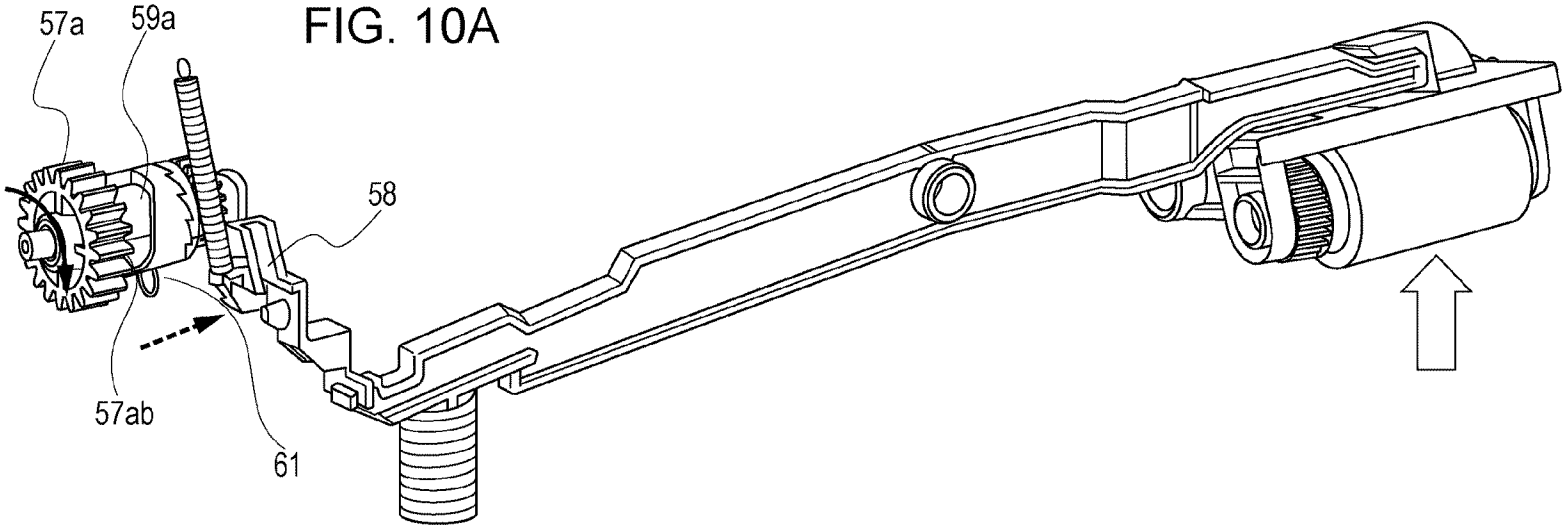
FIGS. 10A and 10B are perspective views of the moving unit in the first embodiment.
Figure 10B:
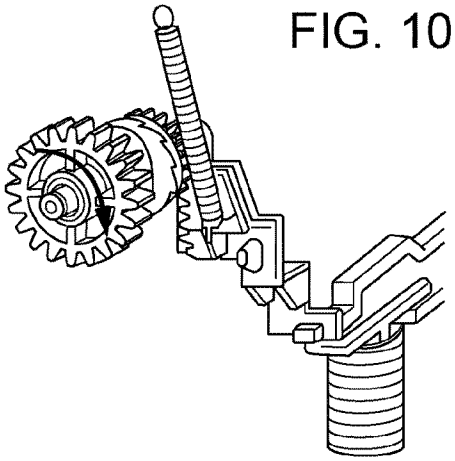

In contrast, when the feeding motor M rotates forward (feeding operation), the gear 57*a* rotates in the counterclockwise direction (direction opposite from the solid arrow) in FIGS. 10A and 10B. At this time, since there is no thrust force acting on the one-way clutch 59, the one-way clutch 59 moves from the gear 57*b* toward the gear 57*a* owing to the inclined shape of the serrations. Thus, the rotation of the gear 57*a* is not transmitted to the gear 57*b*. That is, the one-way clutch 59 transmits the driving force of reverse rotation of the feeding motor M to the separation member 58, but does not transmit the driving force of forward rotation of the feeding motor M to the separation member 58.

Next, the operation of the separation member 58 will be described.

The image forming apparatus A includes the timer 202 that measures the time elapsed from a final job. From the viewpoint of energy saving, when the timer 202 counts (detects) a predetermined time elapsed from the final job, the image forming apparatus A enters a sleep mode in which it stands by with the minimum power consumption.

In contrast, when a state in which the pickup roller 8 is in contact with the sheets S continues from several hours to one day or more, there is sometimes a local influence on the shape and surface property of the sheets S according to the environment of the image forming apparatus A and the surface material of the sheets S. For this reason, in the first embodiment, the CPU circuit part 201 separates the pickup roller 8 from the sheets S by rotating the feeding motor M in reverse by using the elapsed time of the timer 202 as a trigger. That is, the CPU circuit part 201 separates the pickup roller 8 from the sheets S when a feeding operation of the next sheet S is not performed even if a predetermined time elapsed from the end of the feeding operation of the final sheet S by the pickup roller 8. After the pickup roller 8 is separated from the sheets S, the image forming apparatus A enters the sleep mode.

Figures 9A, 9B:
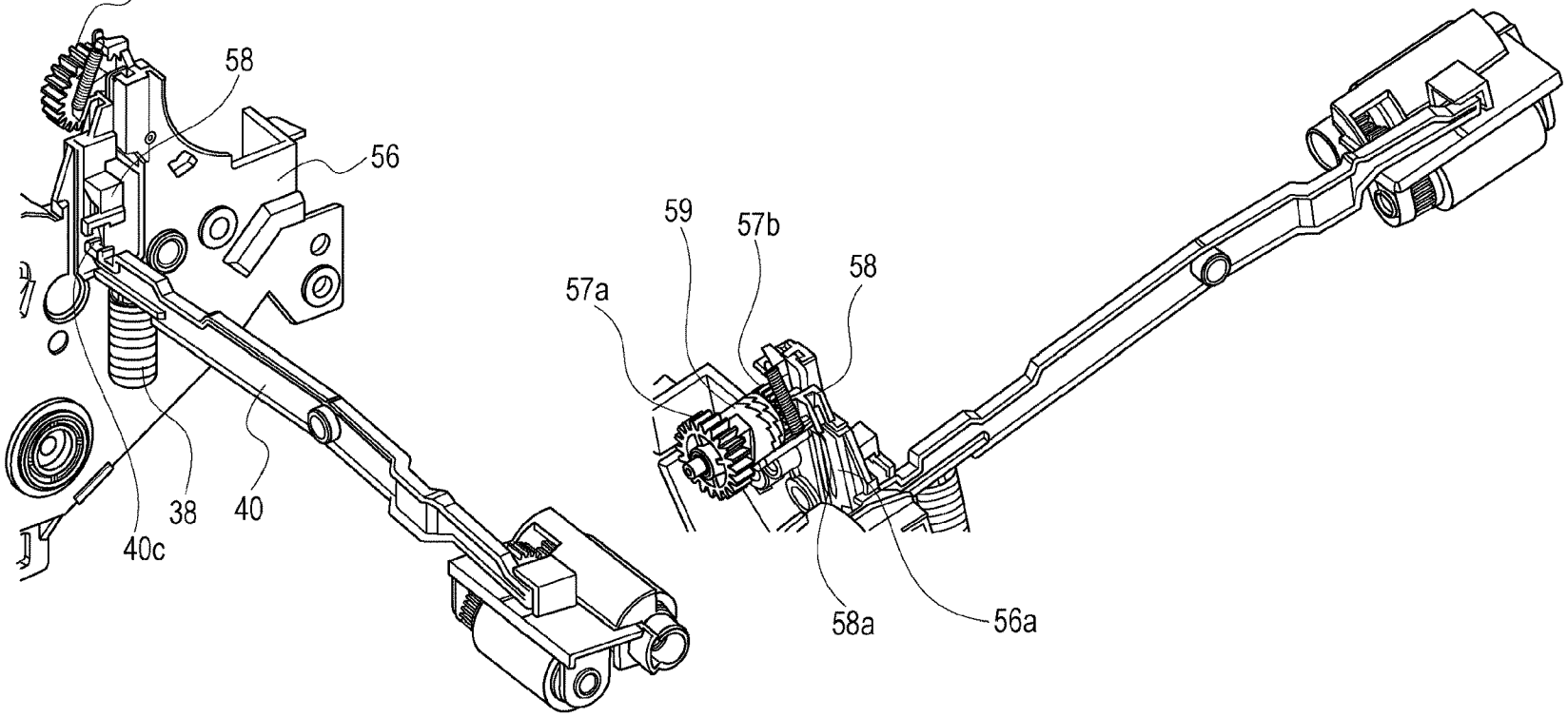
FIGS. 9A and 9B are perspective views illustrating a structure of a moving unit in the first embodiment.

When the feeding motor M rotates in reverse, the separation member 58 receives driving force from the gear 57*b*, and moves to a lower side in FIGS. 9A and 9B. The moved separation member 58 pushes the engaging portion 40*c* of the press lever 40 at the above-described inverse-U shaped portion. The pushed press lever 40 pivots (turns in the counterclockwise direction in FIGS. 9A and 9B), and moves up the roller holder 47 and the pickup roller 8 supported by the roller holder 47. Thus, the pickup roller 8 separates from the uppermost one of the sheets S that are stacked on the lifted stack plate 21 and are ready for feeding. The position of the separation member 58 at this time is referred to as a second position. That is, when the separation member 58 moves (moves downward) from the first position to the second position, it pushes (contacts) the press lever 40 against the elastic force of the compression spring 38, so that the roller holder 47 moves up.

The moving amount of the separation member 58 is set on the basis of the reverse rotation time (reverse rotation amount) of the feeding motor M so that the pickup roller 8 is located at the position sufficiently apart from the uppermost sheet S. That is, when the CPU circuit part 201 rotates the feeding motor M in reverse by a first predetermined amount, the separation member 58 located at the first position moves to the second position against the elastic force of the tension spring 60. Thus, the pickup roller 8 located at the contact position in contact with the sheets S moves to a retracted position retracted upward from the contact position.

Figure 11A:
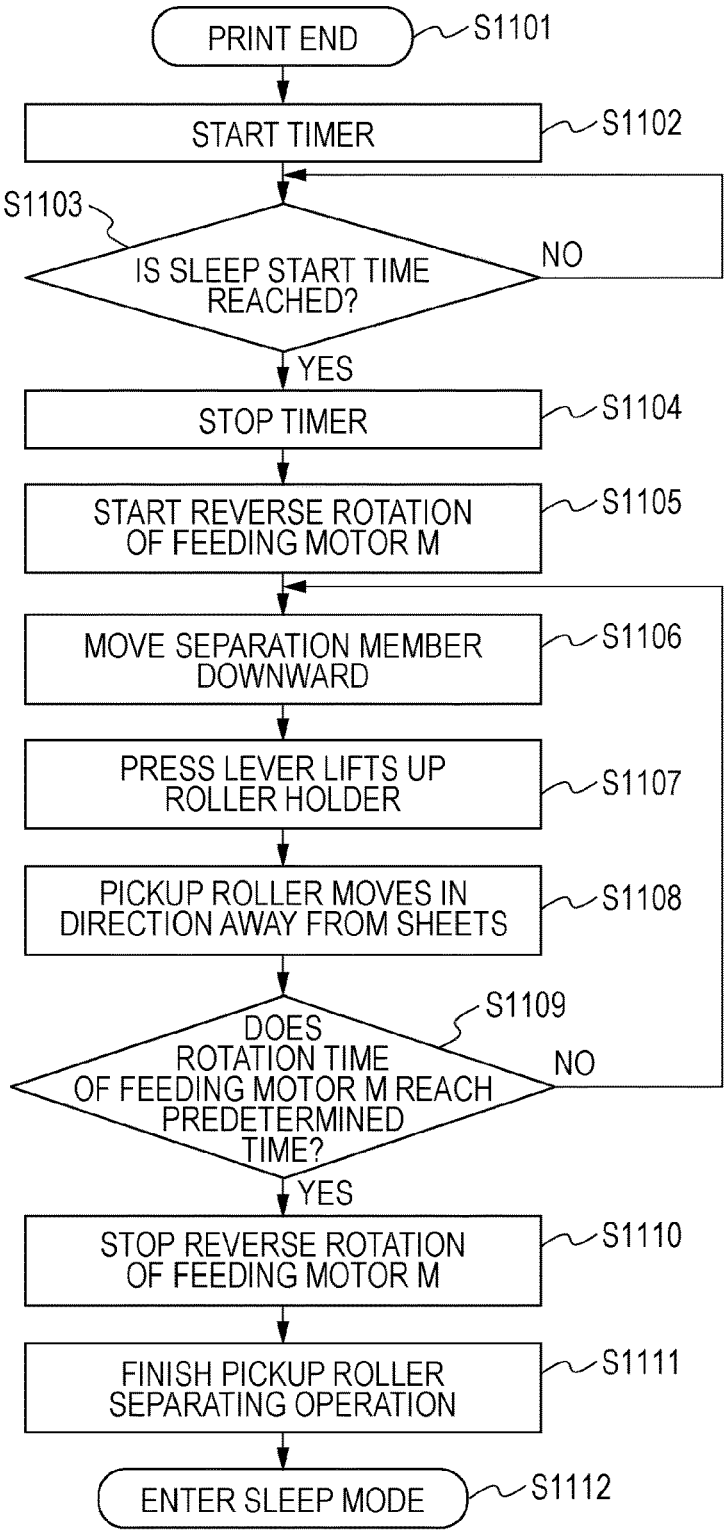
FIGS. 11A and 11B are a flowchart and a timing chart, respectively, relating to contact and separating operations of a pickup roller in the first embodiment.
Figure 11B:
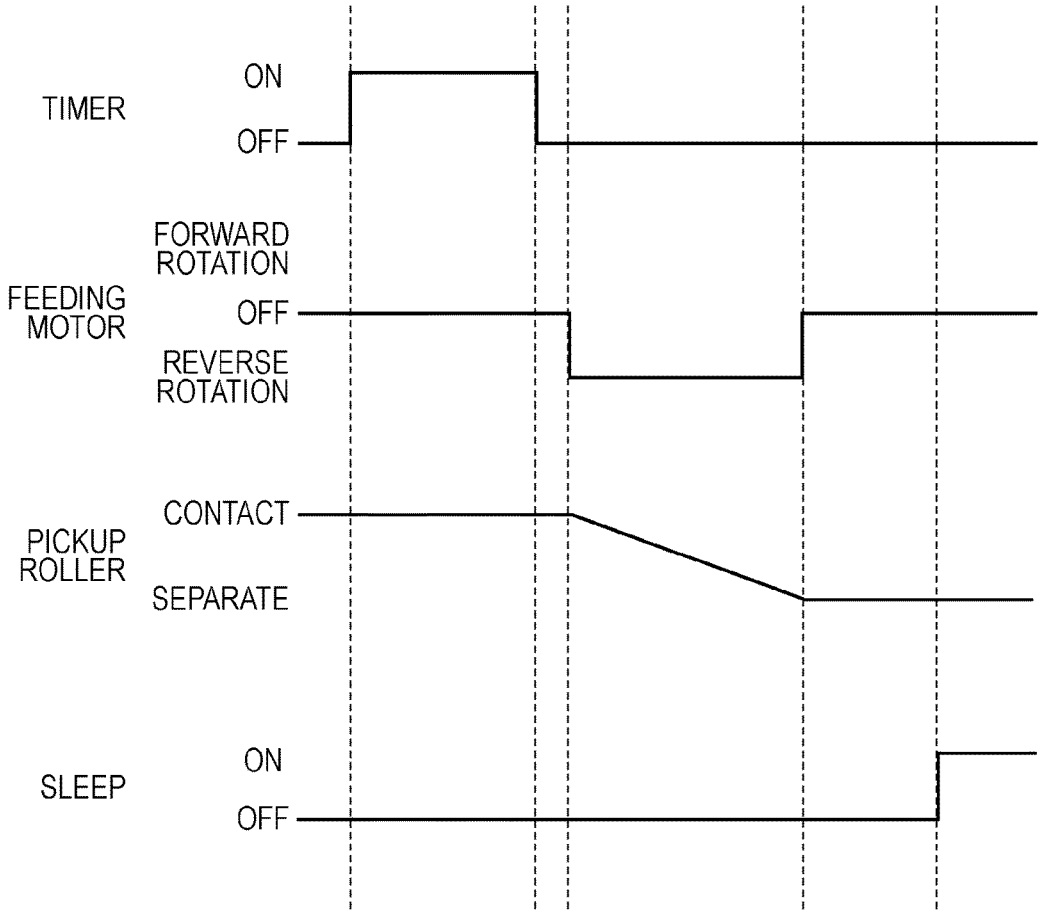

FIGS. 11A and 11B are a flowchart and a timing chart, respectively, of the first embodiment. When a feeding operation is started (that is, the feeding motor M rotates forward), the gear 57*b* is in a state where it does not receive driving force, as described above. Hence, the separation member 58 is pushed up by the forces of the compression spring 38 and the tension spring 60, and the press lever 40 pivots (turns in the clockwise direction in FIGS. 9A and 9B). When the pickup roller 8 comes into contact with the sheets S, the pivotal movement of the press lever 40 stops. The separation member 58 further moves upward, and returns to the first position where it is disengaged from the engaging portion 40*c* of the press lever 40.

In the first embodiment, the tension spring 60 is provided to prevent a phenomenon in which the separation member 58 does not return to the first position, for example, because of friction loss after the gear 57*b* and the separation member 58 are disengaged. In this case, even if the apparatus stops during the contact and separating operation owing to, for example, power failure, the CPU circuit part 201 can reliably return the separation member 58 to the first position by rotating the feeding motor M forward by a second predetermined amount. That is, the CPU circuit part 201 can move the separation member 58 from the second position to the first position by rotating the feeding motor M by the second predetermined amount. Thus, the pickup roller 8 located at the retracted position moves to the contact position. That is, in the first embodiment, the separation member 58, the tension spring 60, and the one-way clutch 59 constitute a moving unit that moves the pickup roller 8 between the contact position and the retracted position. The second predetermined amount may be equal to the first predetermined amount.

According to the above-described first embodiment, there is no need for a detector (sensor) that detects the position of the pickup roller 8. Further, since the separation member 58 is not in contact with the press lever 40 at the first position, it does not have any influence on the feeding pressure. In the first embodiment, as illustrated in FIG. 9A, the point where the compression spring 38 works and the point where the separation member 58 engages are arranged in almost the same straight line as the turn center of the press lever 40. Therefore, a phenomenon in which the press lever 40 is deflected and a desired separation state is not obtained when the pickup roller 8 separates is prevented.

In this way, in the first embodiment, the contact and separating operations of the pickup roller 8 are achieved at energy saving, with small size, and at low cost by utilizing the forward and reverse rotations of the feeding motor M while using the one-way clutch 59.

In the state in which the pickup roller 8 is separate from the sheets S, the force of the compression spring 38 for generating the feeding pressure acts on the feeding motor M. The speed reduction ratio between the feeding motor M and the separation member 58 is set so that the force of the compression spring 38 does not exceed the detent torque of the feeding motor M. That is, the state in which the separation member 58 is located at the second position is maintained by the detent torque of the feeding motor M. While the moving amount of the separation member 58 is controlled by the reverse rotation time of the feeding motor M in the above first embodiment, it is clear that advantages similar to those of a structure in which the step number of a stepping motor is managed can be expected.

When separating the pickup roller 8 from the sheets S, the CPU circuit part 201 interrupts transmission of driving of the electromagnetic clutches 54*a* and 54*b* in the drive train illustrated in FIGS. 6A and 6B so as not to transmit the driving to the feed-roller shaft 41 and the pinion 27 (lifting member). Similarly, the CPU circuit part 201 also interrupts transmission of driving of the electromagnetic clutches 54*a* and 54*b* when rotating the feeding motor M forward to move the pickup roller 8 from the retracted position to the contact position. The present invention should not be limited to the structure including the electromagnetic clutches, and transmission of driving may be controlled by a partially-toothless gear and a solenoid.

Figure 12A:
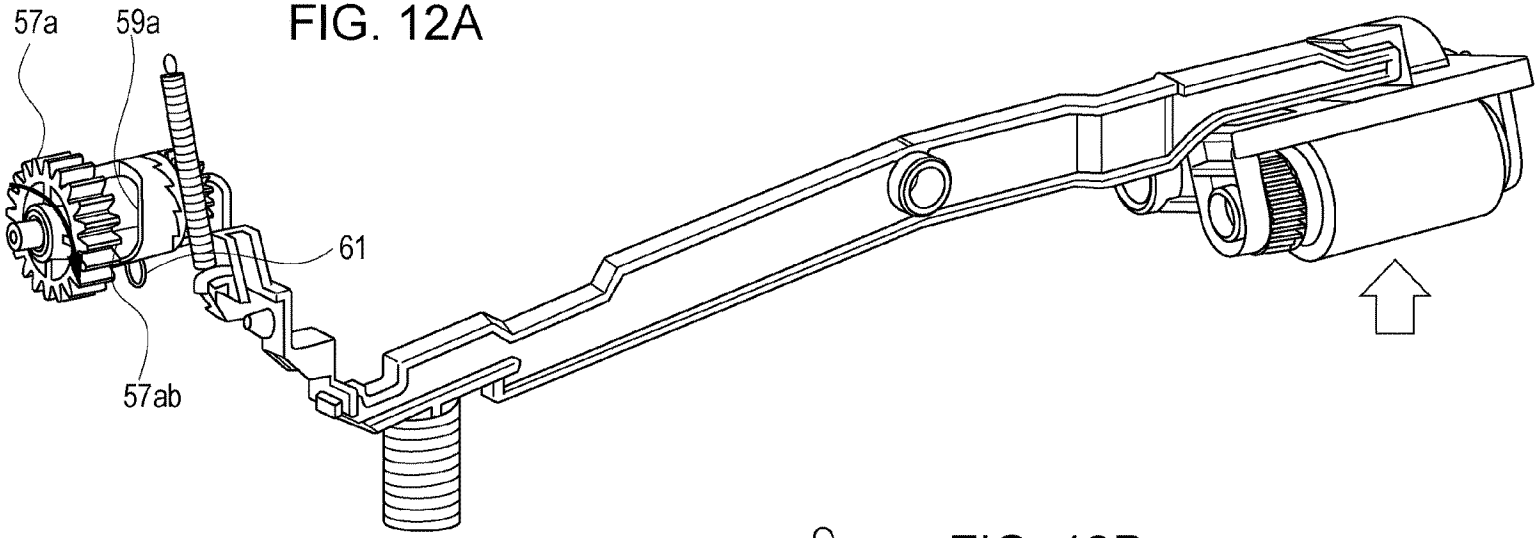
FIGS. 12A and 12B are perspective views illustrating the contact and separating operations of the pickup roller in the first embodiment.
Figure 12B:
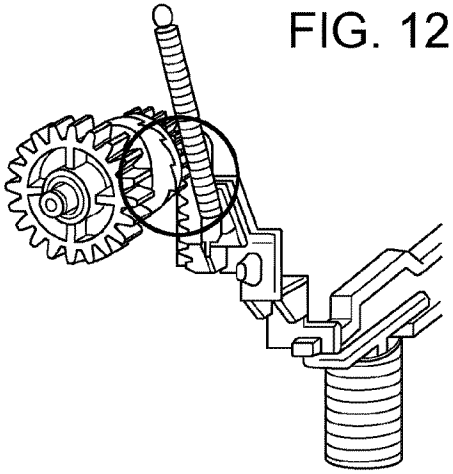

A case in which the separation member 58 is further moved downward from the second position, for example, owing to control fluctuation or malfunction of the apparatus (excessive separation state) is assumed (FIGS. 12A and 12B). In such a case, since the length of the rack is adjusted (set to have a predetermined number of teeth) in the first embodiment, even if the gears 57*a* and 57*b* continue rotation for a long time, only tooth skipping occurs between the rack and the gear 57*b* for inputting the driving force to the rack. Therefore, in the first embodiment, it is possible to prevent breakage of the components of the separation mechanism and the feeding unit (a part encircled in FIG. 12B).

As described above, since the pickup roller 8 is separated when the feeding cassette 24 is drawn out of the feeding device 13, the operating force of the user can be reduced.

Figure 13A:
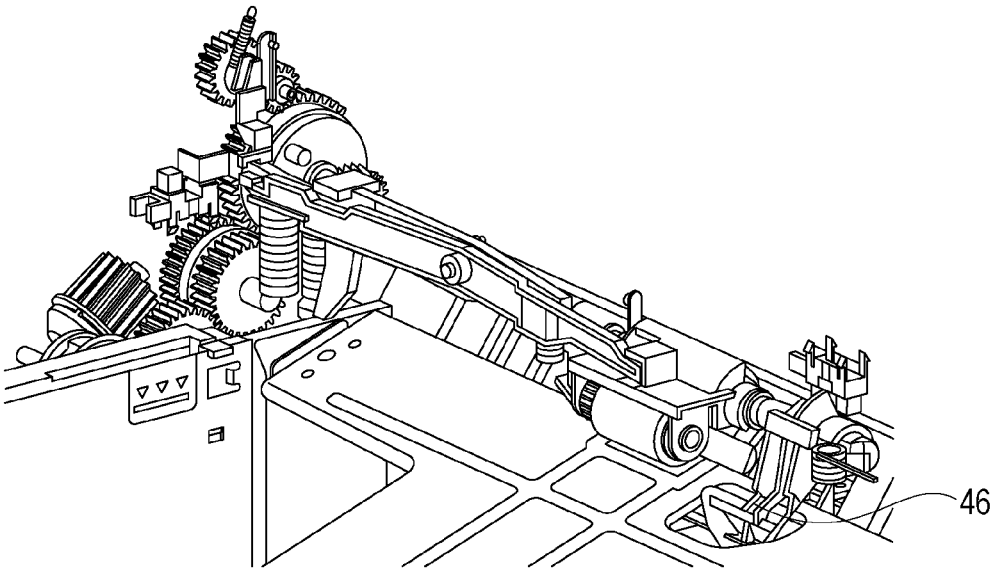
FIGS. 13A and 13B are perspective views illustrating a state in which there is no sheet on a stack plate in the first embodiment.
Figure 14A:
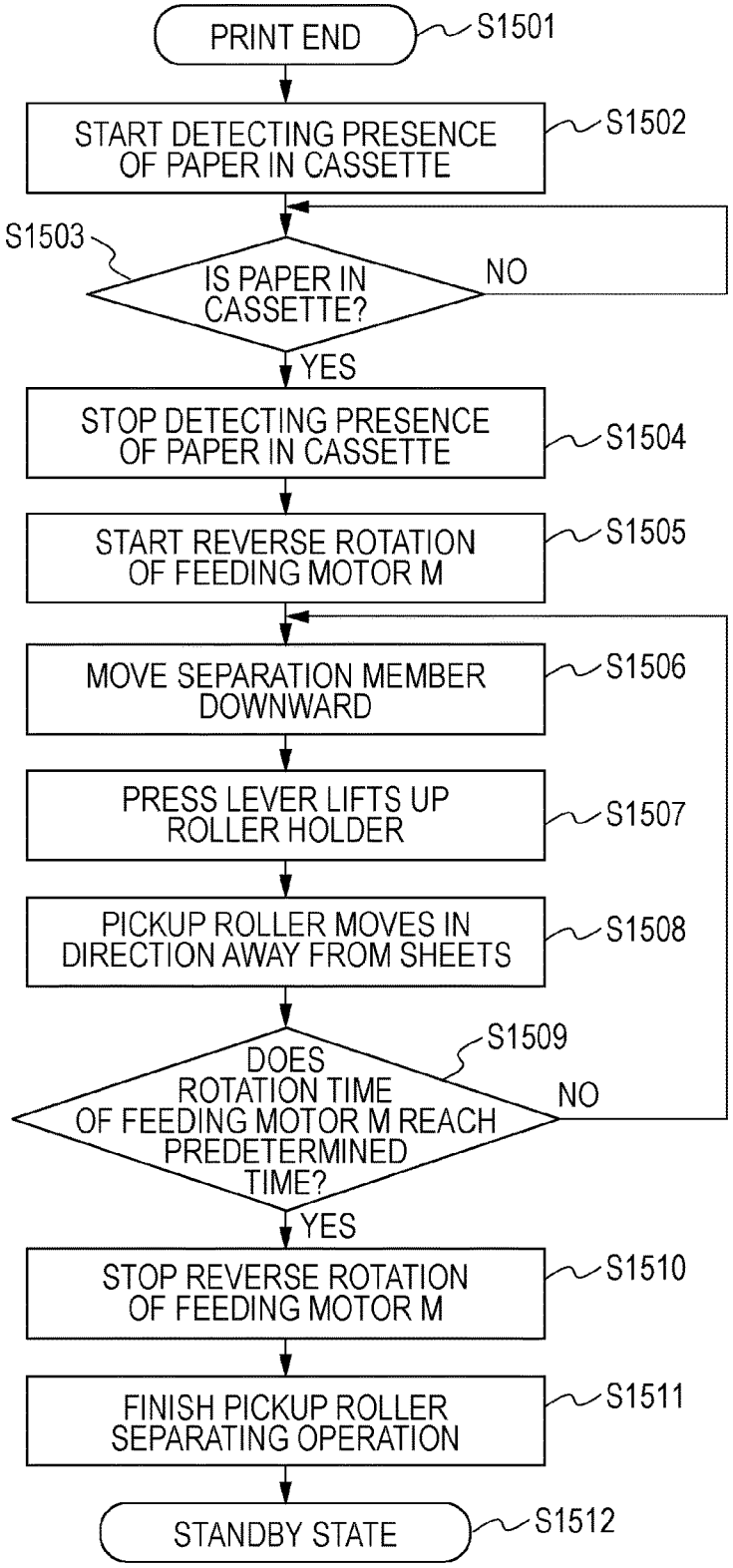
FIGS. 14A and 14B are a flowchart and a timing chart, respectively, relating to the contact and separating operations of the pickup roller in the state in which there is no sheet on the stack plate in the first embodiment.
Figure 14B:
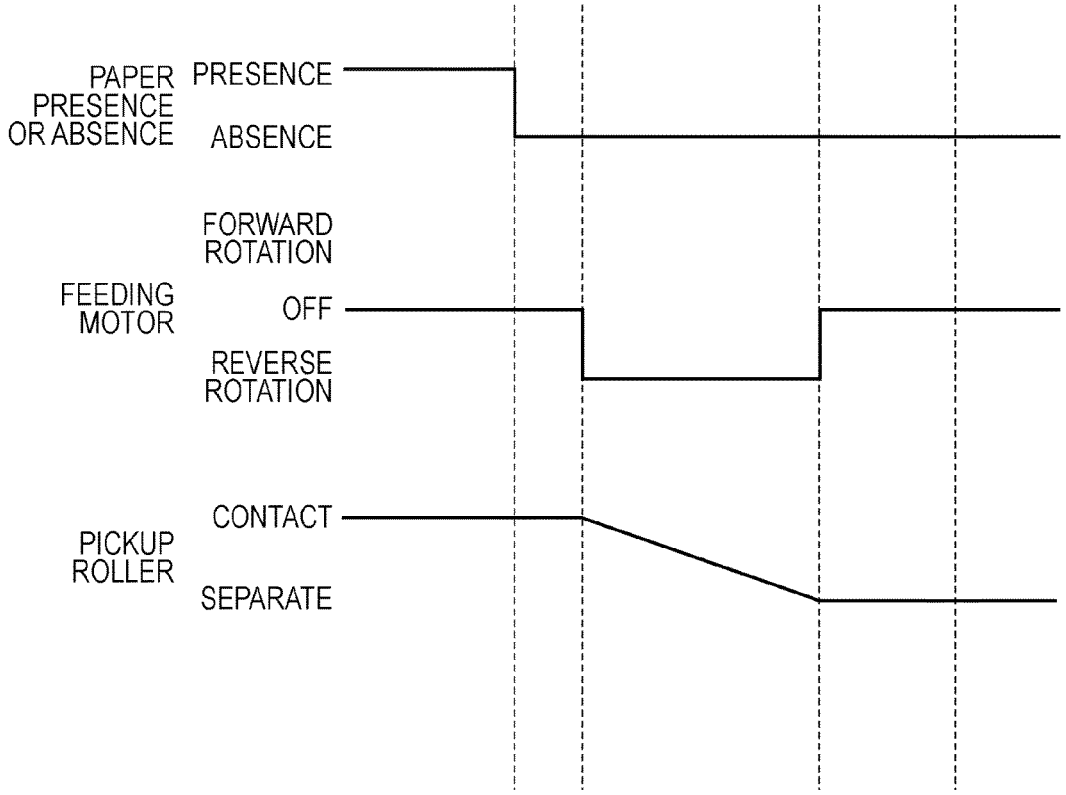

FIG. 13A illustrates a state in which there is no sheet S on the stack plate 21. In the structure of the first embodiment, when there is no sheet S on the stack plate 21, the pickup roller 8 is separated from the stack plate 21. More specifically, when the paper presence sensor 45 detects that there is no sheet S on the stack plate 21, the CPU circuit part 201 rotates the feeding motor M in reverse to separate the pickup roller 8 from the stack plate 21. FIGS. 14A and 14B are a flowchart and a timing chart, respectively, relating to the above operation.

Figure 13B:
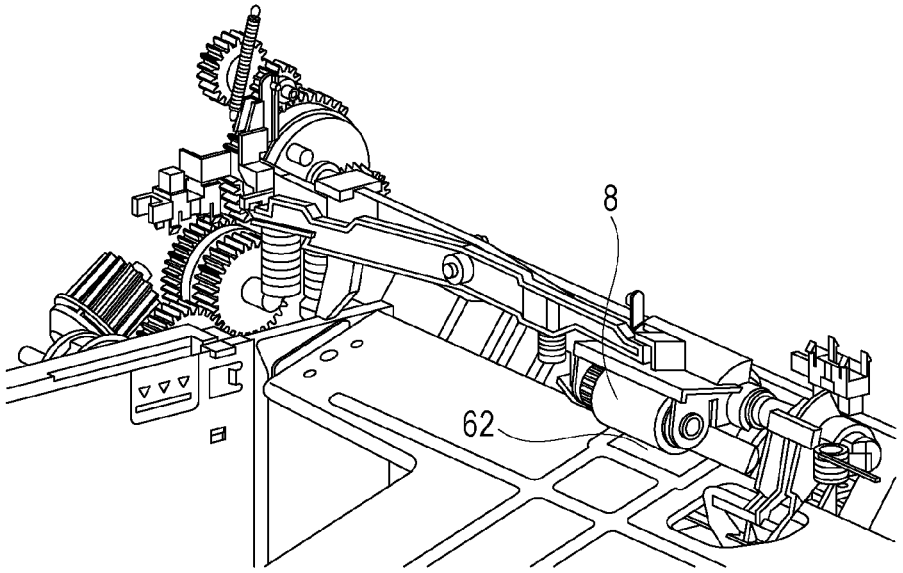

As illustrated in FIGS. 13A and 13B, a separation member 62 having a comparatively high friction coefficient, such as rubber, is provided in a portion of the stack plate 21 opposed to the pickup roller 8 so as to prevent multi-feeding of final ones of the stacked sheets. For this reason, when there is no sheet S on the stack plate 21, the pickup roller 8 is in contact with the separation member 62, and the operating force of the user for drawing out the feeding cassette 24 is increased by the frictional force. In contrast, in the first embodiment, the CPU circuit part 201 separates the pickup roller 8 on the basis of the detection result of the paper presence sensor 45 using the paper presence flag 46. Therefore, according to the first embodiment, it is also possible to reduce the force necessary for the user to draw the feeding cassette 24 out of the feeding device 13.

While the above-described control is such that the pickup roller 8 is separated on the basis of the count of the timer 202, the present invention is not limited thereto. As will be described later, in the first embodiment, control for separating the pickup roller 8 is executed on the basis of an OFF signal from a power switch 203 provided in the main body of the apparatus.

Figure 15A:
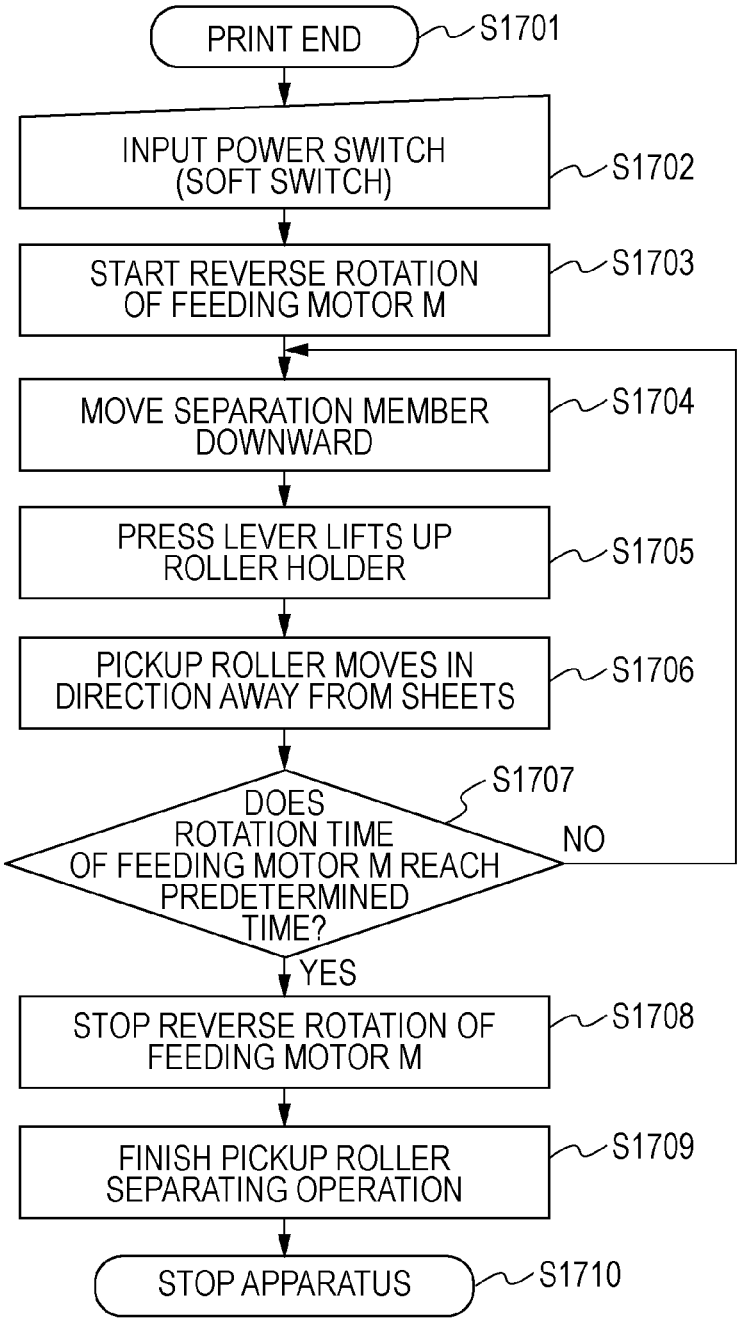
FIGS. 15A and 15B are a flowchart and a timing chart, respectively, relating to contact and separating operations of the pickup roller based on a power switch in the first embodiment.
Figure 15B:
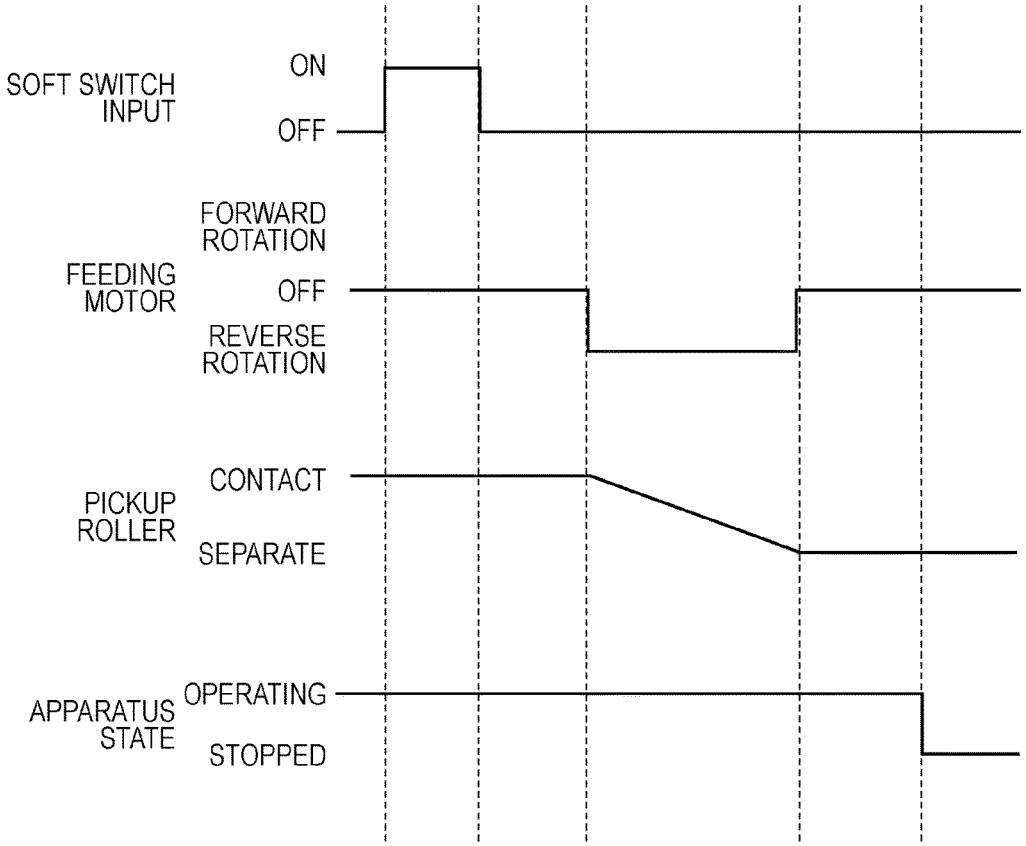

The power switch 203 is an input unit of a soft switch. More specifically, when the user operates the power switch 203 and the power switch 203 outputs an OFF signal, the CPU circuit part 201 rotates the feeding motor M in reverse by the first predetermined amount to separate the pickup roller 8 from the sheets S. After that, the apparatus is brought into a stop state. FIGS. 15A and 15B are a flowchart and a timing chart, respectively, relating the above operation.

As described above, in the present invention, even if the feeding device 13 does not include the timer, the pickup roller 8 may be separated in response to the OFF signal from the power switch 203.

Second Embodiment

Next, a second embodiment will be described. In the following description of the second embodiment, descriptions of structures and operations common to the first embodiment are skipped appropriately. A feeding device according to the second embodiment is different from the first embodiment in the structure of a moving unit that moves a pickup roller 8 between a contact position (contact operation) and a retracted position (separating operation).

Figure 16B:
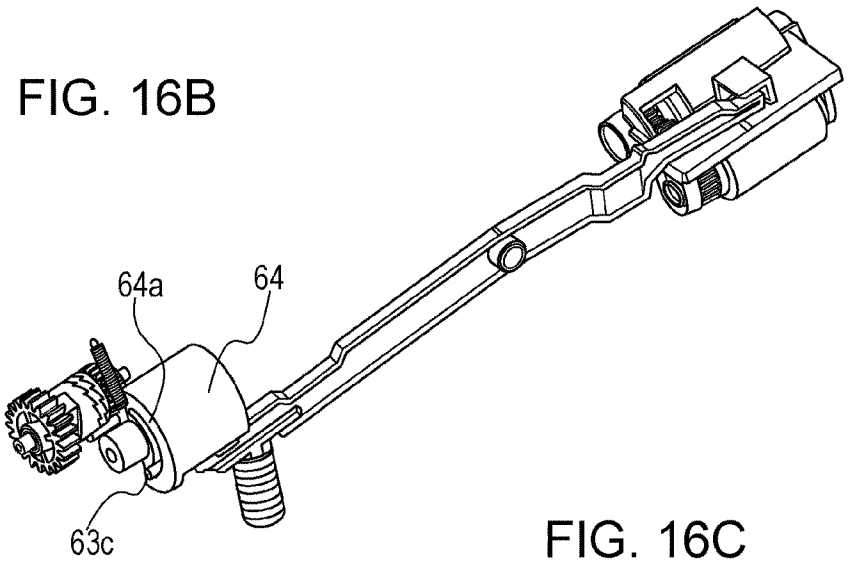
FIGS. 16A to 16C are perspective views illustrating a structure of a moving unit in a second embodiment.
Figure 16C:
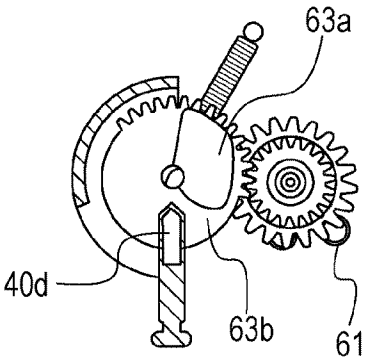
Figure 16A:
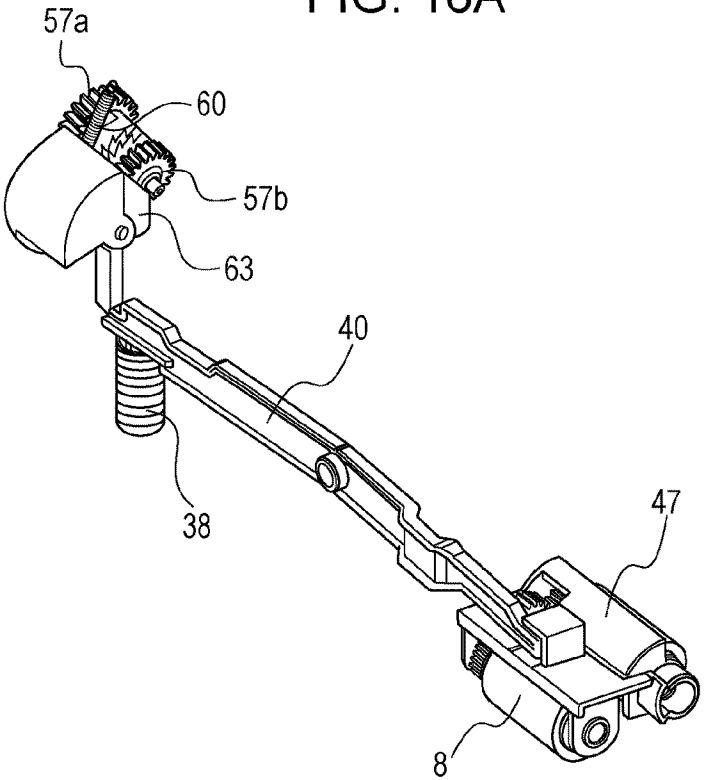
Figure 17A:
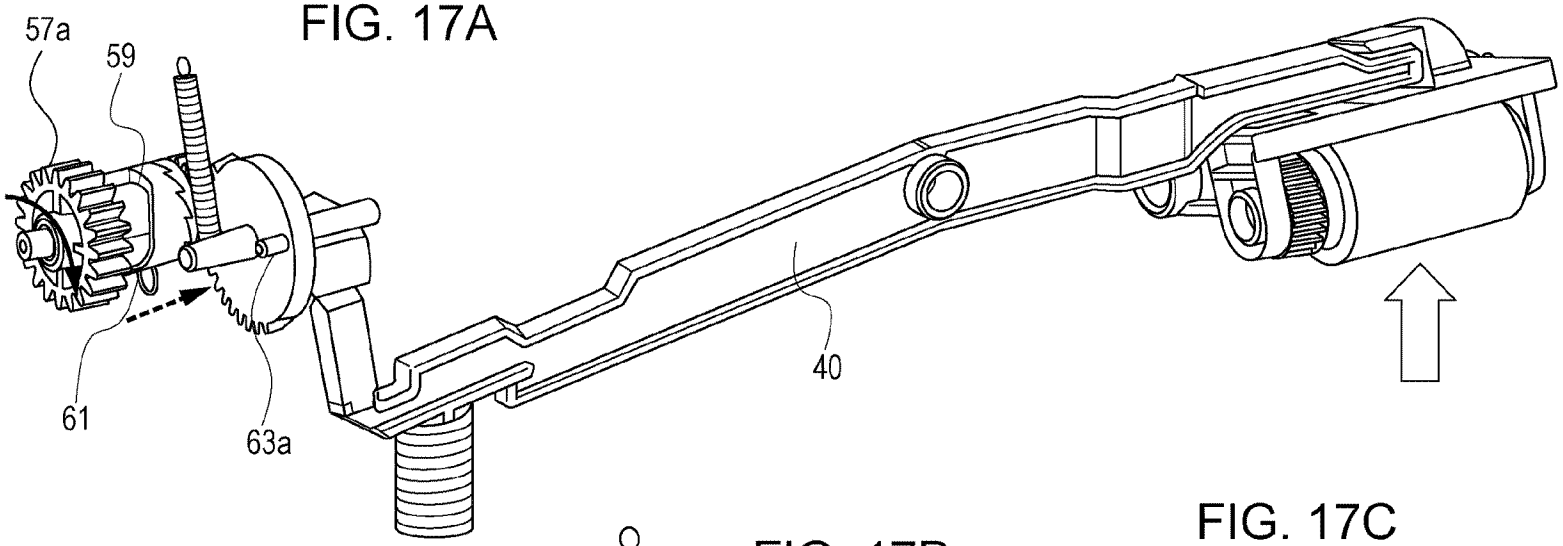
FIGS. 17A to 17C are perspective views illustrating the structure of the moving unit in the second embodiment.
Figure 17B:
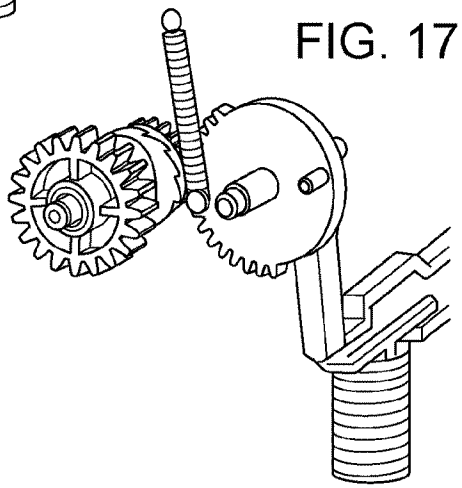
Figure 17C:
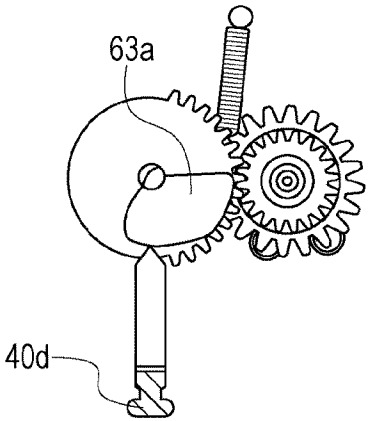
Figure 18A:
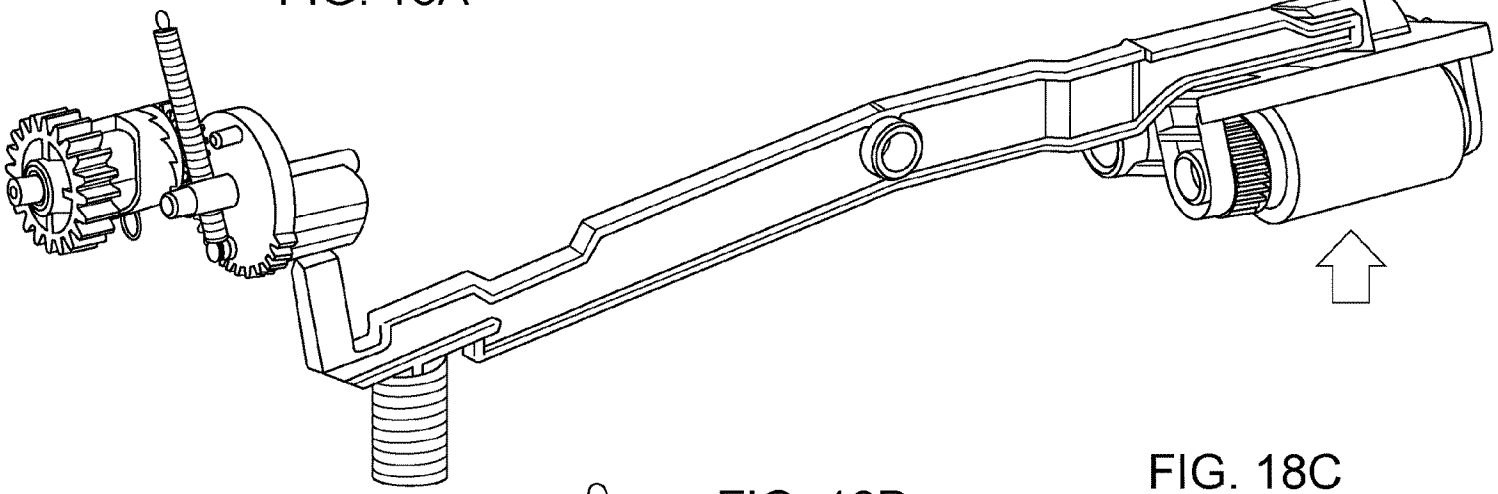
FIGS. 18A to 18C are perspective views illustrating the structure of the moving unit in the second embodiment.
Figure 18B:
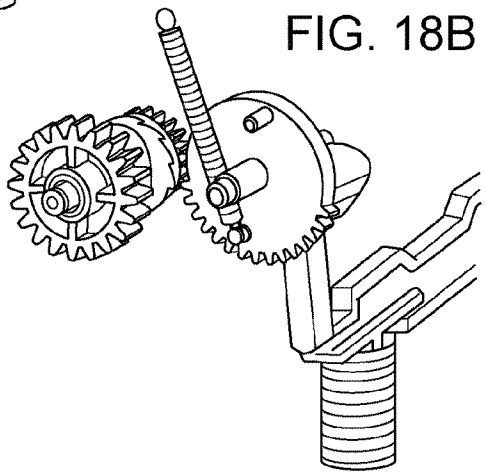
Figure 18C:
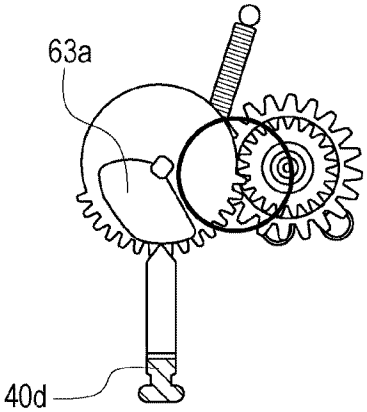
Figure 19:
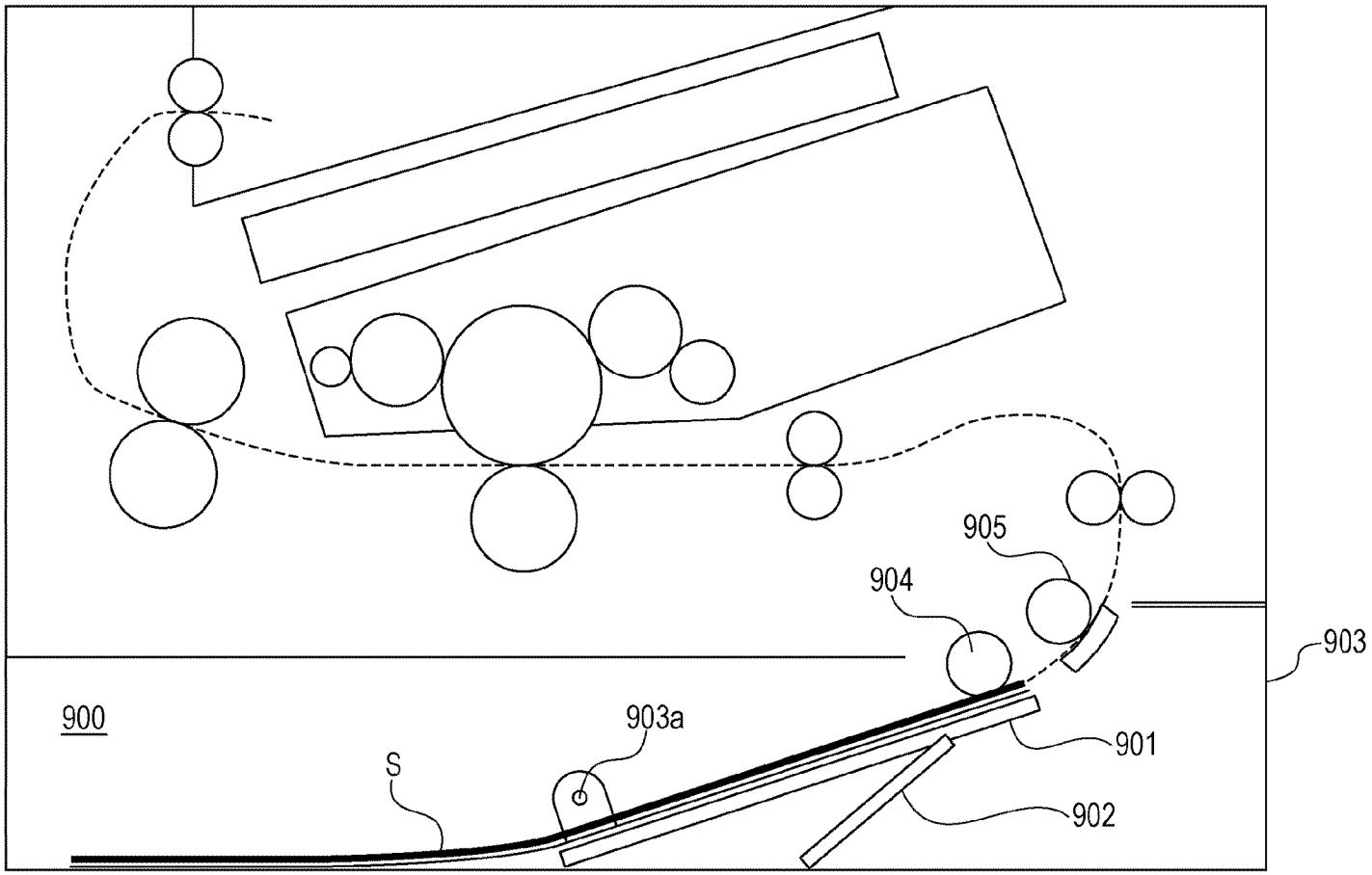
FIG. 19 illustrates a structure of a feeding cassette of the related art.

FIGS. 16A to 16C, 17A to 17C, and 18A to 18C are perspective views illustrating the structure of the moving unit in the feeding device of the second embodiment. FIGS. 16A, 17A, and 18A are perspective views of related components, as viewed from the rear side of a product, and FIGS. 16B, 17B, and 18B are perspective views of the related components, as viewed from the front side of the product. FIGS. 16C, 17C, and 18C are enlarged views of a gear engagement portion and a cam portion.

A gear holder 64 is held in a driving frame 56. The gear holder 64 holds a cam gear 63. The cam gear 63 includes a cam portion 63*a*, a gear portion 63*b*, and a boss 63*c*. When driving force is transmitted from a gear 57*b* to the gear portion 63*b*, the cam gear 63 turns relative to the gear holder 64.

FIGS. 16A to 16C illustrate a state in which the pickup roller 8 is located at the contact position. At this time, as illustrated in FIG. 16B, the boss 63*c* of the cam gear 63 is stopped while abutting on a rim portion of a slot 64*a* of the gear holder 64 owing to the force received from a tension spring 60. At this time, as illustrated in FIG. 16C, the cam portion 63*a* is separate from a rib 40*d* of a press lever 40.

FIGS. 17A to 17C illustrate a state in which the pickup roller 8 is located at the retracted position. Similarly to the first embodiment, a gear 57*a* is rotated in a direction of solid arrow in FIG. 17A by the driving force from a feeding motor M. Then, the gear 57*a* rotates a gear 57*b* via a one-way clutch 59. Then, the cam gear 63 rotates, and the cam portion 63*a* pushes the rib 40*d* of the press lever 40 downward, as illustrated in FIG. 17C. In this way, a roller holder 47 is lifted by the press lever 40, and the pickup roller 8 moves from the contact position to the retracted position.

FIGS. 18A to 18C illustrate a state in which the cam gear 63 is further rotated from the state of FIGS. 17A to 17C. According to the second embodiment, the phases of the cam portion 63*a* and the gear portion 63*b* in the cam gear 63 are set properly. Therefore, in the second embodiment, if the cam gear 63 continues rotation for a long time, only tooth skipping occurs between the gear 57*b* and the gear portion 63*b*. Thus, the components of a separation mechanism and a feeding unit can be prevented from breakage (a section encircled in FIG. 18C).

Similarly to the first embodiment, the pickup roller 8 can be returned from the retracted position to the contact position (returned from the state of FIGS. 18A to 18C to the state of FIGS. 16A to 16C) by rotating the feeding motor M forward by a second predetermined amount.

As illustrated in FIGS. 16C, 17C, and 18C, a compression spring 38, the rib 40*d* of the press lever 40, and the rotation center of the cam gear 63 are arranged in the same straight line. Since the cam curvature center of the cam portion 63*a* is disposed on the same straight line as the rotation center of the cam gear 63, the torque for rotating the cam gear 63 owing to the force of the compression spring 38 is not generated when the pickup roller 8 separates. Thus, according to the second embodiment, the speed reduction ratio from the feeding motor M to the gear 57*a* can be set to be lower than in the first embodiment.

While the driving unit includes the feeding motor M capable of rotating forward and in reverse in the above-described embodiments, the present invention should not be limited thereto. For example, the driving unit may include a motor that rotates in one direction and a clutch that changes the direction of rotation output from the motor.

While the present invention is applied to the laser printer A in the above-described embodiments, it should not be limited thereto, and may be applied to other image forming apparatuses such as a copying machine and a multifunction apparatus. Further, while the electrophotographic image forming process is given as an example of the image forming section for forming an image on a sheet in the above-described embodiments, the present invention should not be limited to the image forming section using the electrophotographic image forming process. For example, the present invention may be applied to an apparatus in which an image forming section for forming an image on a sheet uses an inkjet image forming process for forming an image on a sheet by discharging ink liquid from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-115305, filed Jun. 3, 2014, which is hereby incorporated by reference herein in its entirety.

What is claimed is:

1. A feeding device that feeds a sheet, the feeding device comprising:

a feeding cassette including a stack member on which the sheet is stacked, the feeding cassette being detachable from a main body of an apparatus;

a driving unit configured to generate a driving force of forward rotation and a driving force of reverse rotation;

a feeding member configured to feed the sheet stacked on the stack member by rotating in contact with the sheet and provided to be rotated by the driving force of forward rotation from the driving unit;

a holding member configured to hold the feeding member;

a first lever configured to move the feeding member via the holding member, wherein the first lever moves said feeding member between a contact position in contact with the sheet stacked on the stack member and a retracted position retracted upward from the contact position;

a second lever configured to move said holding member by acting on the first lever, wherein the second lever positions the feeding member at the contact position in a case where the feeding cassette is attached to the main body and positions the feeding member at the retracted position in a case where the feeding cassette is pulled out from the main body; and a moving unit configured to move the feeding member located at the contact position to the retracted position by the driving force of reverse rotation from the driving unit and to move the feeding member located at the retracted position to the contact position by the driving force of forward rotation from the driving unit, the moving unit acting on the first lever at a position different from the second lever.

2. The feeding device according to claim 1, wherein the moving unit includes a one-way clutch configured to move the feeding member from the contact position to the retracted position by the driving force of reverse rotation from the driving unit.

3. The feeding device according to claim 2, wherein the moving unit includes a separation member provided movably between a first position and a second position so that the driving forces from the driving unit are transmitted thereto via the one-way clutch, and an elastic member configured to elastically bias the separation member to the first position, and wherein the separation member is moved from the first position to the second position against an elastic force of the elastic member by the driving force of reverse rotation from the driving unit so as to move the feeding member from the contact position to the retracted position.

4. The feeding device according to claim 3, wherein the separation member is kept located at the second position by a detent torque of the driving unit.

5. The feeding device according to claim 3, further comprising:

a feeding elastic member configured to generate an elastic force that biases the feeding member to the contact position; and a connecting member configured to connect the holding member and the elastic member, wherein the separation member pushes the connecting member when moving from the first position to the second position.

6. The feeding device according to claim 3, wherein the moving unit includes a rack gear provided in the separation member and having a predetermined number of teeth, and a gear configured to input a driving force to the rack gear.

7. The feeding device according to claim 1, wherein the driving unit includes a motor.

8. The feeding device according to claim 7, further comprising:

a control unit configured to control rotation of the motor, wherein the control unit moves the feeding member to the retracted position by rotating the motor in reverse by a first predetermined amount and moves the feeding member to the contact position by rotating the motor forward by a second predetermined amount.

9. The feeding device according to claim 8, wherein the control unit moves the feeding member to the retracted position by rotating the motor in reverse by the first predetermined amount after a predetermined time elapses from an end of a sheet feeding operation of the feeding member.

10. The feeding device according to claim 8, wherein the control unit moves the feeding member to the retracted position by rotating the motor in reverse by the first predetermined amount on the basis of an OFF signal from a power switch provided in a main body of the feeding device.

11. The feeding device according to claim 8, further comprising:

a feeding clutch provided in a driving transmission path from the driving unit to the feeding member, wherein the control unit controls the feeding clutch so that the feeding member is not rotated by the driving force of reverse rotation from the driving unit when the motor is rotated in reverse.

12. An image forming apparatus comprising:

the feeding device according to claim 1; and an image forming section configured to form an image on a sheet fed by the feeding device.

* * * * *